US005575489A

United States Patent [19]

Oyen et al.

[11] Patent Number: 5,575,489

[45] Date of Patent: Nov. 19, 1996

[54] SHOCK ABSORBENT IN-LINE ROLLER SKATE

[76] Inventors: Gerald O. S. Oyen, #480 - 601 W. Cordova Street, Vancouver, British Columbia, Canada, V6B 1G1; Francois E. Charron, P.O. Box 169 Suite 101 - 1184 Denman St., Vancouver, British Columbia, Canada, V6G 2M9

[21] Appl. No.: 261,037

[22] Filed: Jun. 14, 1994

Related U.S. Application Data

[63] Continuation-in-part of Ser. No. 50,819, Mar. 22, 1993, Pat. No. 5,330,208.

[51] Int. Cl.[6] ..... A63C 17/04

[52] U.S. Cl. ..... 280/11.22; 280/11.2; 280/11.27; 280/11.28

[58] Field of Search ..... 280/11.22, 11.23, 280/11.2, 11.27, 11.28, 11.115, 87.042

[56] References Cited

U.S. PATENT DOCUMENTS

| | | | |
|---|---|---|---|
| 1,609,612 | 12/1926 | Eskeland . | |
| 1,616,952 | 2/1927 | Dahl . | |
| 2,644,692 | 7/1953 | Kahlert . | |
| 3,880,441 | 4/1975 | Silver . | |
| 4,666,168 | 5/1987 | Hamill et al. | 280/11.2 |
| 4,909,523 | 3/1990 | Olson . | |
| 4,915,399 | 4/1990 | Marandel . | |
| 5,092,614 | 3/1992 | Malewicz . | |
| 5,190,301 | 3/1993 | Malewicz . | |
| 5,192,099 | 3/1993 | Riutta . | |
| 5,398,949 | 3/1995 | Tarng | 280/11.22 |

*Primary Examiner*—Richard M. Camby
*Attorney, Agent, or Firm*—Oyen Wiggs Green & Mutala

[57] ABSTRACT

This invention is directed to in-line roller skates. More particularly, this invention pertains to shock absorbent in-line roller skates wherein the wheels are resilient mounted to navigate over rough, bumpy surfaces. An in-line roller skate comprising: (a) a boot with a heel and toe adapted to receive a foot of a skater; (b) a first wheel supporting rail means secured to an underside of the boot and extending from the heel to the toe; (c) a second wheel supporting rail means secured to an underside of the boot, and extending from the heel to the toe adjacent and generally parallel to the first rail means; (d) a plurality of wheel means mounted in tandem in a line between the first and second rail means, the wheel means being respectively connected to the first and second rail means by respective axle means and bearing means; and (e) a plurality of resilient shock absorbing means located between the respective axle means and bearing means and the rail means to enable the respective wheel means to move under force individually upwardly or downwardly relative to the first and second rail means.

14 Claims, 13 Drawing Sheets

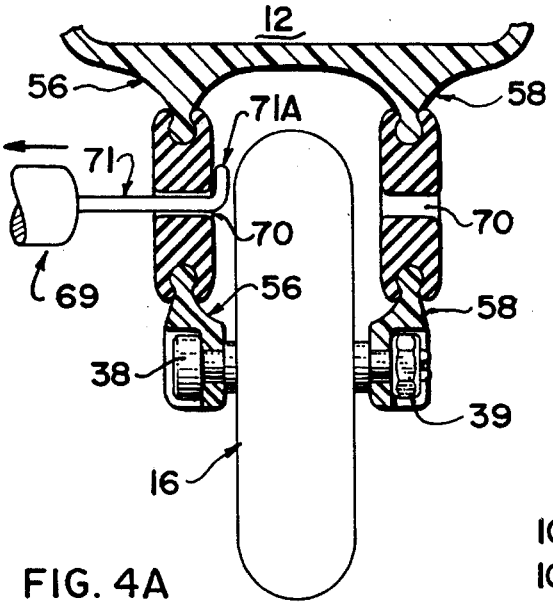
FIG. 4A
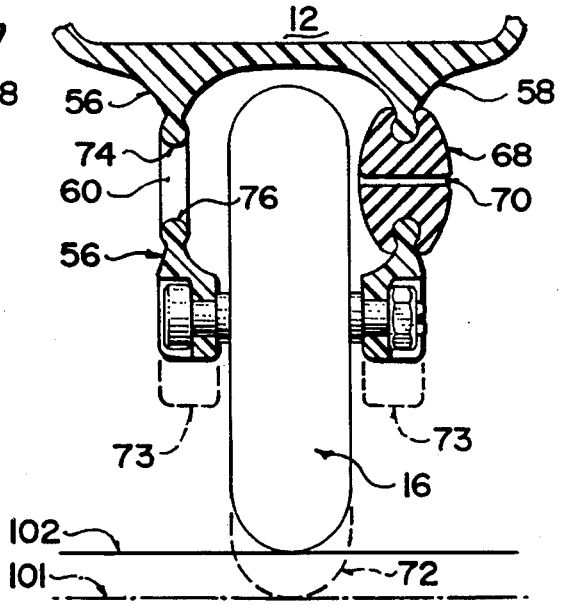
FIG. 4B
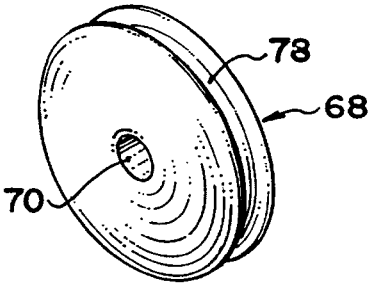
FIG. 4F
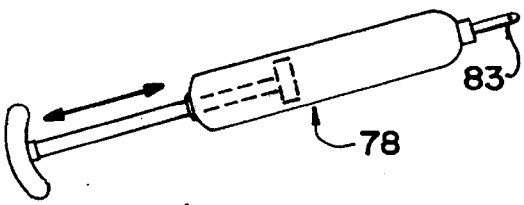
FIG. 4G
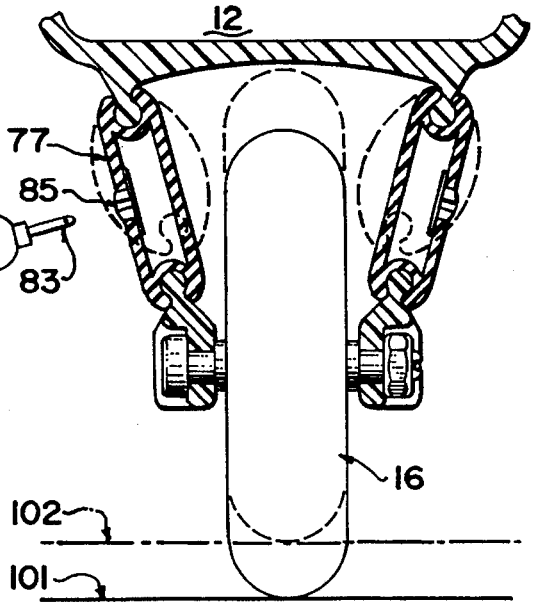

SHOCK ABSORBENT IN-LINE ROLLER SKATE

This application is a continuation-in-part of application Ser. No. 08/050,819, filed Mar. 22, 1993 U.S. Pat. No. 5,330,208.

FIELD OF THE INVENTION

This invention is directed to in-line roller skates. More particularly, this invention pertains to shock absorbent in-line roller skates wherein the wheels are resilient mounted to navigate over rough, bumpy surfaces. The invention also relates to a wheel stopping mechanism which can be activated to retard wheel rotation.

BACKGROUND OR THE INVENTION

In-line roller skates have become very popular with the public in the past few years. However, the in-line roller skates that are available on the market have a number of inherent limitations. For one thing, the wheels and axles are rigidly mounted to the frame member under the boot and there is minimal shock absorbing capacity built into the wheels. Accordingly, it is difficult for a person wearing conventional in-line roller skates to skate over uneven or bumpy surfaces. This is particularly important during long downhill runs at high speeds. Transmission of excessive high frequency low amplitude vibration due to road surface irregularities may blister a skaters foot as well as cause fatigue. Impacts of high amplitude at any frequency may cause a loss of balance and a serious fall.

Existing in-line skates offer limited shock absorption through the use of a slightly soft tire compound which compensates for only minor bumps. Such tires require frequent replacement due to wear and tear. Use of a relatively soft tire compound, while lending more shock absorbing capacity, increases rolling friction and detrimental heat buildup. This may soften the tire, degrade bearings and overall, require greater skating effort, particularly in high ambient temperatures.

Existing in-line skates usually have three to five tandem wheels in relatively rigid horizontal and vertical alignment. In a three wheel skate, when a skater encounters a bump, in forward motion, the initial upward wheel impact forces the toe upward. Impact with the following middle wheel raises the toe still further leaving ground contact substantially with the final wheel. This action tends to destabilize the skater by removing toe contact which normally supplies the best control.

Allowing independent wheel deflection vertically while maintaining lateral rigidity would enable greater control and stability over relatively rough terrain. Transferring the resilient action away from the tire also would allow the use of harder tire compounds Another problem is braking. Most in-line skates have a rear brake pad on one skate. It would be helpful if a wheel rotation stopping mechanism could be used. This would avoid unwanted wheel rotation.

U.S. Pat. No. 4,915,399, Merandel, granted Apr. 10, 1990 discloses a front and rear wheel roller skate design which has a suspension system on the front and rear wheels. The roller skate is equipped at the level of the front and rear pivoting axles, with a suspension system for damping shocks resulting from unevenness of a skating surface. The front and rear pivoting axles are each provided with a suspension system which is fixed at one end on the central part of the pivoting axle, and at the other end being guided by a centring barrel located inside a base of the skate. The pivoting axles are also each equipped with a pivoting system secured at one end to the base by a pivoting device while the other end is secured to an arm of the central part by resilient washers. Marandel does not disclose in-line roller skates. He discloses conventional roller skates with a pair of wheels on a front axle and a pair of wheels on a rear axle.

U.S. Pat. No. 5,092,614, Malewicz, assigned to Rollerblade, Inc., granted Mar. 3, 1992, discloses a lightweight in-line roller skate frame and frame mounting system. The in-line roller skate has a frame including a pair of side rails, each side rail having front and rear mounting brackets for attachment of the frame to the boot of the in-line roller skate. Each frame side rail includes a curved portion and a planar portion. The planar portion carries a plurality of axle apertures through which an axle for a wheel may be inserted. Preferably, the axle apertures are configured to receive an axle aperture plug, have an eccentrically disposed axle bore and are situated on the frame side rails such that the wheels may be mounted at multiple relative heights to each other. Malewicz does not disclose any shock absorbing mechanism for the in-line wheels, or any ability for the wheels to move upwardly or downwardly in order to recede when the wheels impact a bump or obstruction.

SUMMARY OF THE INVENTION

The invention is directed to an in-line roller skate comprising: (a) a boot with a heel and toe adapted to receive a foot of a skater; (b) a first wheel supporting rail means secured to an underside of the boot and extending from the heel to the toe; (c) a second wheel supporting rail means secured to an underside of the boot, and extending from the heel to the toe adjacent and generally parallel to the first rail means; (d) a plurality of wheel means mounted in tandem in a line between the first and second rail means, the wheel means being respectively connected to the first and second rail means by respective axle means and bearing means; and (e) a plurality of resilient shock absorbing means located between the respective axle means and bearing means and the rail means to enable the respective wheel means to move under force individually upwardly or downwardly relative to the first and second rail means.

There are variable choices in the degree and placement of the resilient elements concomitant with greater control and enhanced wear characteristics of the ground engaging wheels.

As an alternative embodiment, the resilient shock absorbing means can be absent and the wheels can have resilient spokes which enable the circumferences of the respective wheels to move upwardly or downwardly relative to the first and second rail means. There can be at least three wheel means and the first rail means and the second rail means can include at least three respective resilient means and the at least three wheel means can be rotationally mounted in the respective resilient means.

A pair of respective resilient shock absorbing means can be used for each wheel, axle and bearing means and the resilient shock absorbing means can be mounted in respective cavities formed in the first and second rail means. The respective resilient shock absorbing means can be resilient members which fit in cavities in the first and second rail means.

At least three spring cavity means can be formed in the first rail means and at least three cavity means can be formed in the second rail means, the cavity means coinciding with the positions of the three wheel means respectively, each cavity means being adapted to receive respective removable resilient shock absorbing means.

The resilient shock absorbing means can be removable and invertible resilient plugs which can be positioned in the respective cavity means in the first rail means and the second rail means, the resilient plugs impinging on the axle and bearing means for each respective wheel means, and absorbing compression force when the respective wheel means moves upwardly, and dispensing compression force when the respective wheel means moves downwardly.

The first and second rail means can have formed therein, in association with the respective cavity means, axle wells which permit the axles to move upwardly or downwardly in relation to the first and second rail means. The invertible resilient plugs can be held in place in relation to the axle means and the rail means by spacer sleeve means. The resilient means can also be held in place by washer means.

The resilient means can have protective covers thereon. Each resilient means can have a crescent shape and can fit in respective vertical elongated cavities in the first rail and second rail means, the axle fitting in the concave curve of the crescent.

The axles can be positioned at a first elevation when the concave side of the crescent faces upwardly and can be positioned at a second lower elevation when the concave side of the crescent faces downwardly.

The respective resilient means can be held in place by respective removable washer means which fit about the respective axle means. The respective resilient means can be held in place by respective spacer sleeves which fit about the respective axle means on a side of the resilient means opposite to the washer means. At least one reinforcing web can be located between the first and second rail means to lend stability.

The invention is also directed to an in-line dual wheel roller skate comprising: (a) a boot adapted to receive a foot of a skater; (b) a resilient wheel supporting means secured to the underside of the boot; (c) at least three pairs of wheels mounted in tandem linear relationship on the wheel support means in dual pair relationship with one another, the dual wheels being individually moveable relative to the boot when a force is exerted on the wheels thereby flexing the wheel supporting means.

The dual wheels can be rotationally mounted on either side of the wheel supporting means by a laterally extending axle, the axle being adapted to pivot upwardly or downwardly in relation to the boot by compressing the wheel supporting means. The wheel supporting means can have positioned therein, at least one resilient spring disc which enables the wheels to move upwardly or downwardly relative to the boot. The wheel supporting means can have one or more compressible cavities thereon.

The wheel support means can have formed therein a cavity which can be adapted to receive a coil spring, the coil spring impinging upon the axle means and enabling the axle means to move upwardly or downwardly in relation to a force exerted upwardly or downwardly on the dual wheels and the axle.

The invention is also directed to an in-line roller skate comprising: (a) a boot adapted to receive a foot of a skater; (b) a resilient yoke-like wheel supporting means secured to an underside of the boot, the supporting means having forward extending and rearward extending fork-like arms; and (c) a plurality of wheels rotatably arranged within the fork-like arms of the wheel support means;

A pair of wheels can be arranged in line between the forward fork-like arm, and a pair of wheels can be arranged between the rearward fork-like arm, and the wheels and arms can move upwardly when the wheels are placed on the ground, to absorb compression forces.

The invention is also directed to an in-line roller skate comprising: (a) a boot adapted to receive a foot of a skater; (b) a resilient wheel mounting means secured to the underside of the boot, longitudinal with the boot, and having an elongated longitudinal wheel receiving cavity therein; with at least one opening formed in the wheel mounting means; (c) a plurality of wheels rotatably mounted in series within the wheel receiving cavity; and (d) a removable resilient compression force absorbing means fitted in the opening in the wheel mounting means.

Alternatively, an opening can be formed in each wall of the wheel mounting means on either side of the wheel receiving cavity, the openings being adapted to receive a plurality of detachable resilient compression force absorbing means. The detachable resilient compression force absorbing means can be formed in the shape of discs which can have a peripheral groove around the circumference thereof, the peripheral groove being adapted to fit with the edges of the opening, the discs receiving axles of the wheel means.

Each wall of the wheel mounting means can have formed therein a plurality of openings, each opening receiving a pair of resilient disc-like compression force absorbing means. The disc-like resilient compression force absorbing means can have compressible openings therein. The disc-like resilient compression force absorbing means can be hollow.

The wheels can have rotatable bearings therein and can be mounted on axles which are secured to the side walls of the wheel supporting means. A pair of disc-like resilient compression absorbing means can be detachably fitted to the wheel mounting means for every axle.

A releasable toe wheel lock for hill or stair climbing may be installed. This wheel lock may be applied to one wheel per boot or simultaneously to two or more if desirable. The wheel lock may operate in a ganged manner.

The invention is also directed to an in-line roller skate comprising: (a) a boot adapted to receive a foot of a skater; (b) a wheel mounting means secured to the underside of the boot, longitudinal with the boot, and having an elongated longitudinal wheel receiving cavity therein; (c) a plurality of wheels rotatably mounted in series within the wheel receiving cavity in longitudinal alignment with one another; and (d) a releasable wheel rotation stop means located between the underside of a toe of the boot and above a forward wheel of the plurality of wheels.

The wheel stop means can move between a first position wherein the stop means can be free of the forward wheel and permits the forward wheel to rotate and a second position wherein the stop means abuts the forward wheel and prevents rotation of the forward wheel. The wheel stop means can have releasable lock means which enables the stop means to be locked in a first or second position.

The wheel stop means can be located between the underside of a heel of the boot and above a rear wheel of the plurality of wheels.

BRIEF DESCRIPTION OF THE DRAWINGS

In the drawings which represent specific embodiments of the invention but which should not be regarded as restricting the spirit or scope of the invention in any way:

FIG. 4A illustrates a section view taken along section line 4A—4A of FIG. 4.

FIG. 4B illustrates a variation of a section view taken along section line 4A—4A of FIG. 4 when the roller wheel is reacting to upward compression, and a disc is on one side only.

FIG. 4F, which appears on the same sheet as FIGS. 4A and 4B, illustrates an isometric view of a resilient shock absorbent spring plug.

FIG. 4G, which appears on the same sheet as FIGS. 4A and 4B, illustrates an end partial section view of a sixth embodiment of the invention with air-filled resilient discs.

DETAILED DESCRIPTION OF SPECIFIC EMBODIMENTS OF THE INVENTION

Figure 1:
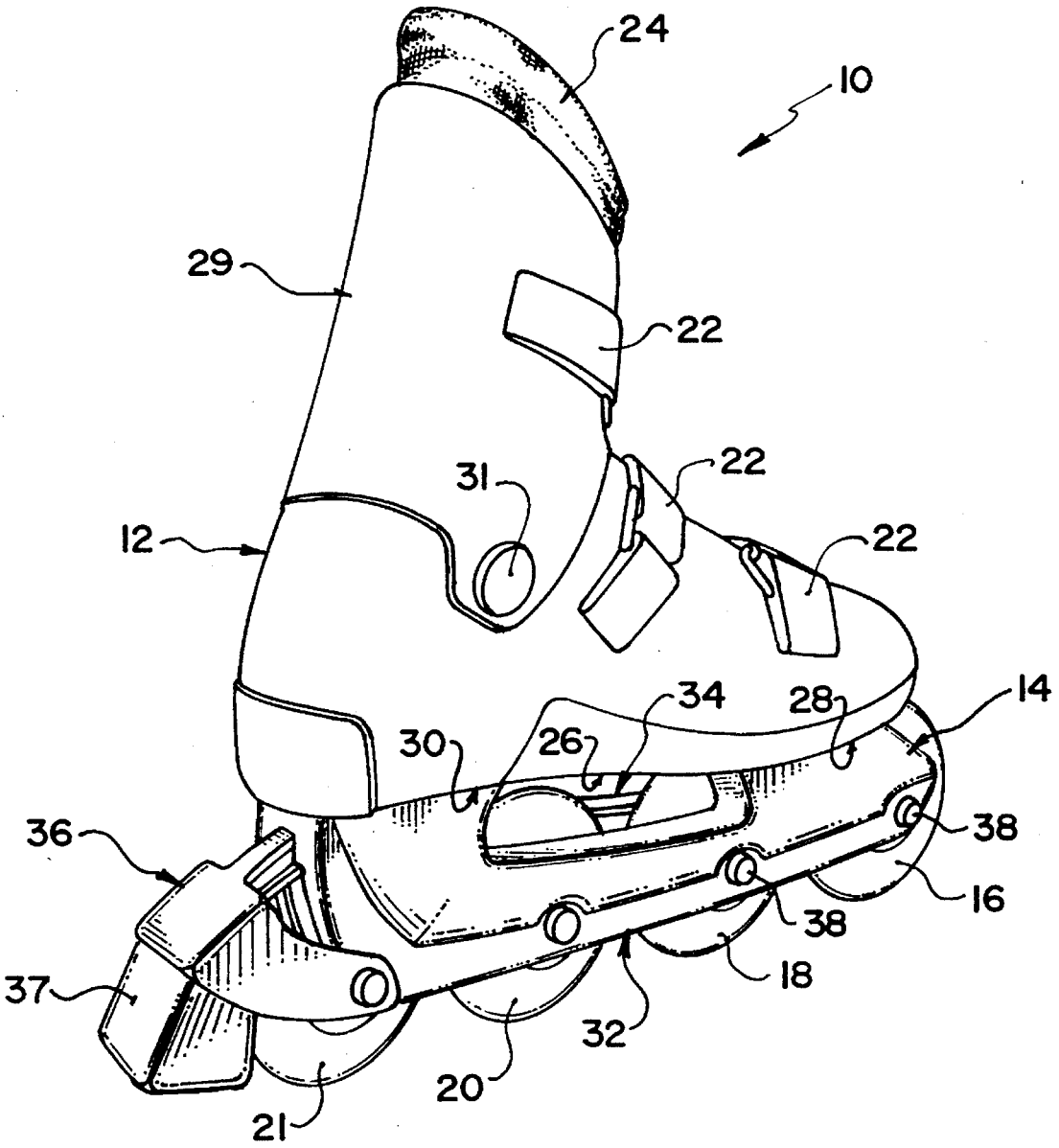
FIG. 1 illustrates a perspective view of a conventional in-line roller skate with four in-line wheels and a rail frame securing the wheels to a boot.

FIG. 1 illustrates in perspective view a conventional in-line roller skate 10. The skate 10 includes a boot 12 and a rigid wheel frame 14 attached on the underside thereof. Frame 14 rotatably supports four in-line wheels which are identified from front to rear respectively as wheels 16, 18, 20 and 21. Frame 14 is attached to the under-sole 26 of boot 12 at a front sole attachment 28 and a rear sole attachment 30. Frame 14 includes parallel first and second side rails 32 and 34 respectively. Side rail 34 is partly visible in FIG. 1. The side rails 32 and 34 are used for mounting the axles of the wheels 16, 18, 20 and 21. Frame 14 may include at the rear a brake assembly 36 having a braking pad 37 which a skater may use to assist in stopping forward or reward motion, by pressing the pad against the ground.

Boot 12 includes an ankle cuff 29 which is pivotally attached to boot 12 by a cuff pivot point 31. Boot 12 further includes a plurality of boot closure means 22 for closely conforming the boot 12 to a skater's foot. As shown in FIG. 1, closure means 22 are individual buckle type closures, which are conventional. Other known means of tightening a boot onto a foot, such as laces and eyelets, or hook and pile fastener straps are also feasible and are within the scope of the present invention. Boot 12 may include a soft absorbent liner 24 which may be removable if desired.

Figure 2:
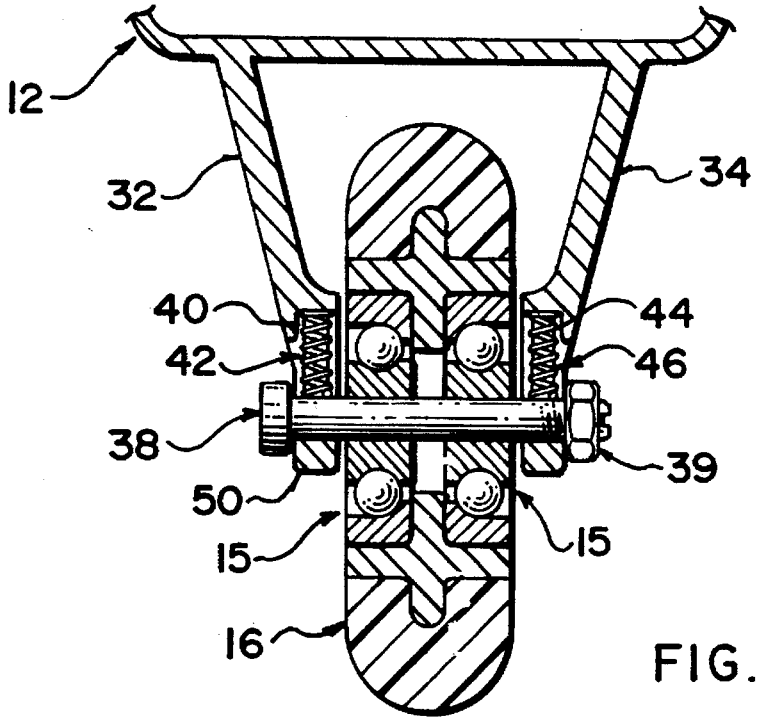
FIG. 2 illustrates a front partial section view of an in-line roller wheel, spring-mounted to a wheel carrying frame attaching the wheel and axle to the boot.

FIG. 2 illustrates a front partial section view of a wheel 16, which is rotatable on an axle 38. The axle 38 rotates in a pair of ball bearings 15 in the wheel 16, which is conventional. The bearings 15 reduce friction and minimize heat development when the wheels 16, 18, 20 and 21 (see FIG. 1) rotate while the skater is skating. The axle 38 is held in place by nut 39. The first side rail 32 is constructed to include therein a vertical cavity 40 which can receive a coil spring 42. The top end of the coil spring 42 bears against the top of the cavity 40, which is slightly notched. At its lower end, the spring 42 bears against the top side of axle 38. The wheel 16 rotates by bearings 15 on the axle 38 which is basically stationary. The second side rail 34 is constructed to have therein a similar second spring cavity 44 and a second coil spring 46. This construction with dual springs 42 and 46, one on each side of the wheel 16, enables wheel 16 to move upwardly or downwardly (depending upon the degree of softness of the springs 42 and 46) against the pair of springs 42 and 46 respectively when the wheel 16 contacts an obstruction or bump in the ground surface over which the skate is traversing. The construction also permits a slight amount of lateral tilting of the wheel 16, which can be controlled by the degree of stiffness of the coil springs 42 and 46.

The other three wheels illustrated in FIG. 1, namely, wheels 18, 20 and 21, are similarly equipped with corresponding coil springs and cavities in the side rails 32 and 34 in order to enable those wheels to also yield upwardly against the springs when bumps or obstructions are encountered on the ground surface. The springs 42 and 46, and the other springs, are selected to have sufficient compression force to carry the weight of the skater. The springs can be removed and replaced with springs of other compressive force to proportionately accommodate the weight of lighter or heavier skaters. Spring systems other than coil springs, for instance, resilient rubber blocks, or leaf springs may be used.

Figure 3:
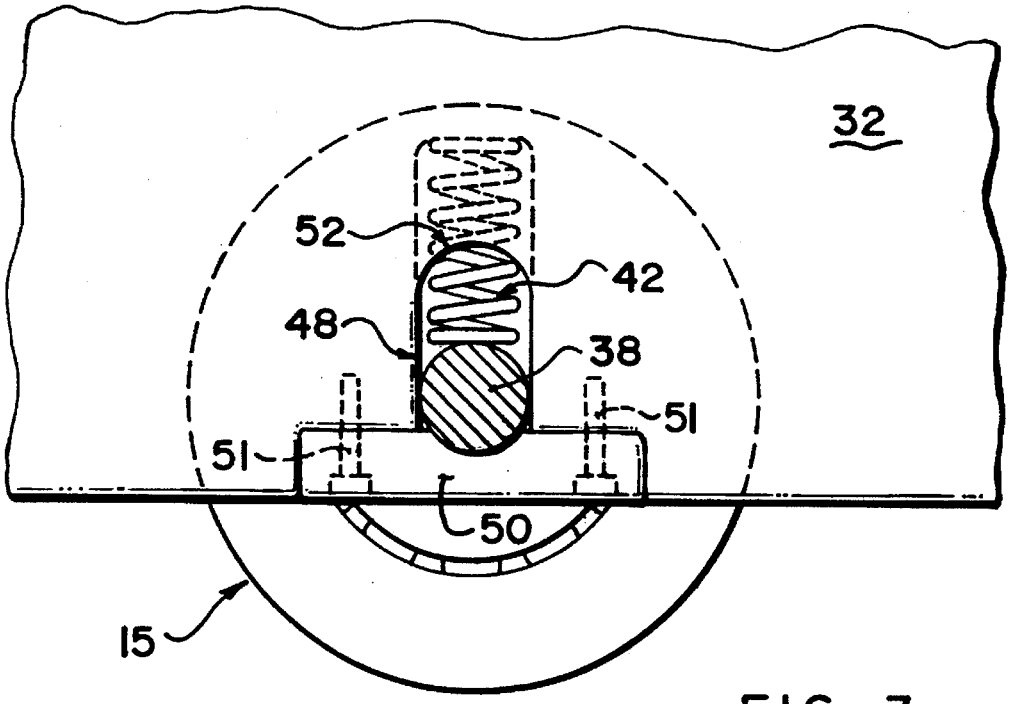
FIG. 3 illustrates a side view of a wheel bearing and axle, spring-mounted to a frame of an in-line roller skate.

FIG. 3 illustrates a side view of the axle 38, wheel bearing 15 and spring construction illustrated in FIG. 2. The wheel 16 is not shown. In FIG. 3, it can be seen that side rail 32 has formed therein a vertical longitudinal axle well 48, in which axle 38 and wheel 16 can move upwardly or downwardly within fixed limits. Forward or rearward movement of the axle and wheel a restricted. The downward movement of axle 38 and wheel 14 is restricted by cross bar 50. Bar 50 is held in place against rail 32 by a pair of counter sunk screws 51. Likewise, the upward movement of axle 38 and bearing is limited by the top 52 of well 48. As seen in FIG. 3, wheel 16, which rotates about axle 38 by means of the ball bearings 15, is free to move upwardly against the downward force exerted by coil spring 42, whenever the bottom of wheel 16 hits an obstruction in the ground surface over which the skater is skating. The distance of axle travel between bar 50 and the top 52 of well 48 is sufficient to enable the spring 42 to absorb the shock caused by most bumps encountered by the skater. While spring 42 is visible in FIG. 3, as depicted, side rail 32 can be designed and formed (such as by injection molding) to provide a cover for spring 42, and well 48, so that they are not visible. This may be desirable for cosmetic or design reasons or retard inclusion of foreign particles.

As used in this disclosure the term "resilient material" means a material which is elastic, recoils. rebounds and resumes shape and size after being stretched or compressed under a force, which is subsequently removed.

Figures 4, 18:
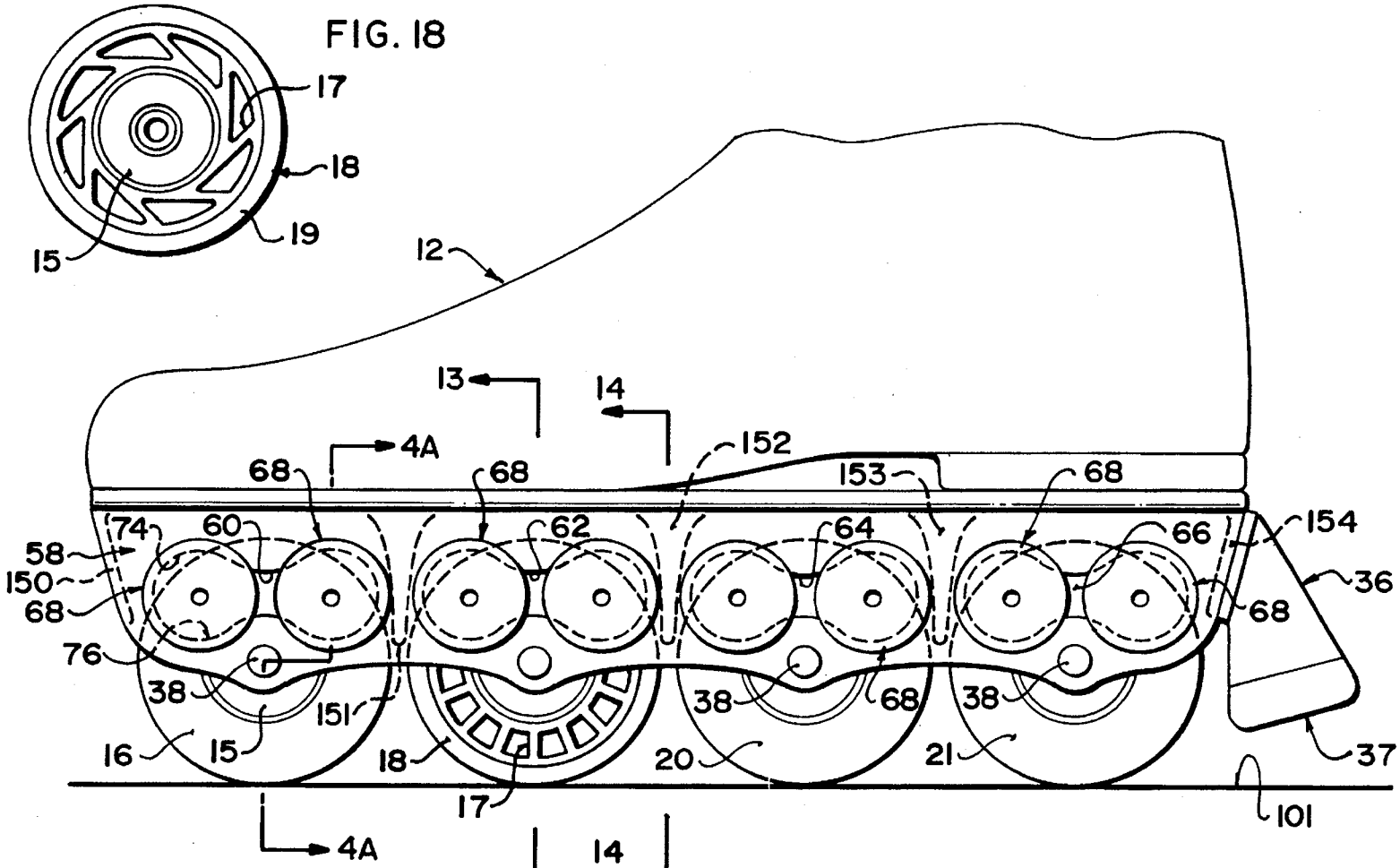
FIG. 4 illustrates a side view of a second embodiment of shock absorbent in-line roller skate and boot design comprising elastic shock absorbing rails with variable density shock absorbing discs in receptacles.
FIG. 18, which appears on the same sheet of drawings as FIG. 4, illustrates a spring action angled spoke shock absorbing wheel.

FIG. 4 illustrates a side view of a second embodiment of shock absorbent in-line roller skate and boot design. As with the previous design, the boot 12 (shown schematically) has four wheels 16, 18, 20 and 21 on the underside thereof, and a brake assembly 36 and pad 37 at the rear end thereof. However, in the second embodiment illustrated in FIG. 4, the pair of parallel side rails 56 and 58 (side rail 58 is visible in FIG. 4) have a different construction. The side rail 58 is typically constructed of a resilient strong material such as extruded high density polyethylene, polypropylene, or some other suitable material, (which can, if desired, be reinforced with glass or graphite fibres) which provides both rigidity, strength and a certain amount of flexibility. The material should be relatively rigid in the linear alignment direction and reasonably flexible in the vertical direction to prevent linear wobble of the wheels, but allow some vertical movement of the wheels. The side rail 58 is extruded to have formed therein a series of four dumbbell shaped openings, 60, 62, 64 and 66. The centre of each dumbbell opening 60, 62, 64 and 66 is positioned above the axle 38 of the underlying wheel. The regions between the adjacent ends of each dumbbell opening 60 can be reinforced, if desired, to increase strength and rigidity.

FIG. 4 also illustrates in dotted lines a series of lateral stabilizing webs 150, 151, 152, 153 and 154 which lend additional lateral stability to the side rails 56 and 58. These webs assist in preventing the wheels from wobbling laterally out of tandem alignment.

Fitted in the large opening at each end of the dumbbell 60 are a series of spring plugs or discs 68 which are formed of a suitable compressible material, such as a polyurethane elastomer, or the like. These spring plugs or discs 68 act like compression springs and provide shock absorbing capacity to the wheels when the wheels contact bumps or uneven terrain. The spring discs 68 can be exchanged with either softer or firmer versions in order to provide the desired amount of shock absorbing or spring action to the dumbbell 60 and spring disc 68 combination. The elasticity of each disc can be individually selected to customize the bump absorbing action or some or all of the discs may be removed to produce desired shock absorbing action. The degree of elasticity may be chosen with regard skater weight and ability for various road conditions and skating styles. The discs may be colour coded for density e.g. clear or translucent for lighter elements, grading to dark for less resilient discs. Alternatively, the discs may be patterned and coloured for coding or for decorative purposes.

FIG. 4, as an alternative embodiment, illustrates second forward wheel 18 having an enlarged hub, spoke and rim assembly 17. Prior art wheels have large relatively soft tires to absorb a very limited amount of shock. These tires fail to dissipate heat adequately and thereby increase bearing stresses. These factors generate increasing rolling friction both in the bearing and tire compound. The soft tire compound and bearings of the prior art thus tend to wear more quickly and require more effort to increase speeds. The hub, spoke and rim assembly 17 serves to provide better cooling while the low profile tire inherent with the assembly 17 may be of a harder wear resistant nature. While only one wheel 18 is shown, it will be understood that all four wheels may be of the spoked design.

As an alternative embodiment, the spoked wheel 18 may be constructed of different materials to provide shock absorbing action or reduction in weight.

FIG. 4A illustrates a section view taken along section-line 4A—4A of FIG. 4. In FIG. 4A, spring discs 68 are shown at each side. For purposes of illustration, a plug remover 69 and hooked rod 71 are shown removing the disc 68 in the opening 60. The discs may be press fitted for installation, with or without a tool. The first side rail 56 extends downwardly from the boot 12 at the left side of the figure, while the parallel side rail 58 extends downwardly the right side of the figure. The dual side rail combination 56, 58 can be injection molded as a unit, and fibre reinforced, which is evident in FIG. 4A. The axle 38 extends through the base regions of the side rail combination 56, 58, and is secured with nut 39 on the opposite side. The axle 38, and nut 39 combination holds the wheel 16 in the interior opening provided by the parallel spaced side rails 56 and 58.

FIG. 4B illustrates, in section view, upper lip 74 and lower lip 76 which are formed in the upper and lower regions of the dumbbell opening 60. The upper lip 74 and lower lip 76 are designed to engage snugly with the groove 78 which is formed around the periphery of the spring disc 68. In FIG. 4B, the upper lip 74 and lower lip 76 are shown having a rounded form, and the groove 78 in the spring disc 68 also has a congruent rounded form. However, the respective configurations can have different designs, for instance, square, triangular, dove-tail, and the like, if greater interaction between the groove 78 and the respective lips 74 and 76 is required. In FIG. 4B, no disc 68 is shown in the left side opening 60. This can be by design. As a rule, however, discs 68 are normally installed on both sides.

As seen in FIG. 4A, the spring disc 68 is in a non-compressed configuration. However, when the wheel 16 encounters a bump or an obstruction of some sort (level 102), the wheel 16 is forced upwardly, as illustrated in FIG. 4B, which illustrates a section view taken along section line 4A—4A of FIG. 4, except in the depiction illustrated in FIG. 4B the roller wheel 16 is under upward compression. The initial position of wheel 16 is indicated by dashed lines 72. The upward movement of the wheel 16 forces the axle 38, nut 39 to move upwardly as indicated by dashed lines 73. As is evident in FIG. 4B, this upward action compresses dumbbell opening 60, and spring disc 68. Spring disc 68 absorbs the upward compressive force by contracting vertically and expanding laterally. A similar action would take place in a companion spring disc 68 if it were fitted in left dumbbell opening 60. The spring disc 68 has an opening 70 through the centre thereof. The size of this opening 70 can be varied in order to provide increased control over compressibility of the spring disc 68. As a general rule, the larger the spool opening 70, the more resilient is the spring disc 68. However, compressibility is also governed by the degree of elasticity of the elastomeric material from which spring disc 68 is formed. The opening is also used to enable the disc 68 to be installed or removed by disc remover 69 as shown in FIG. 4. Further embodiments of wheel discs are discussed below and illustrated in FIGS. 19 to 24.

Figure 4C:
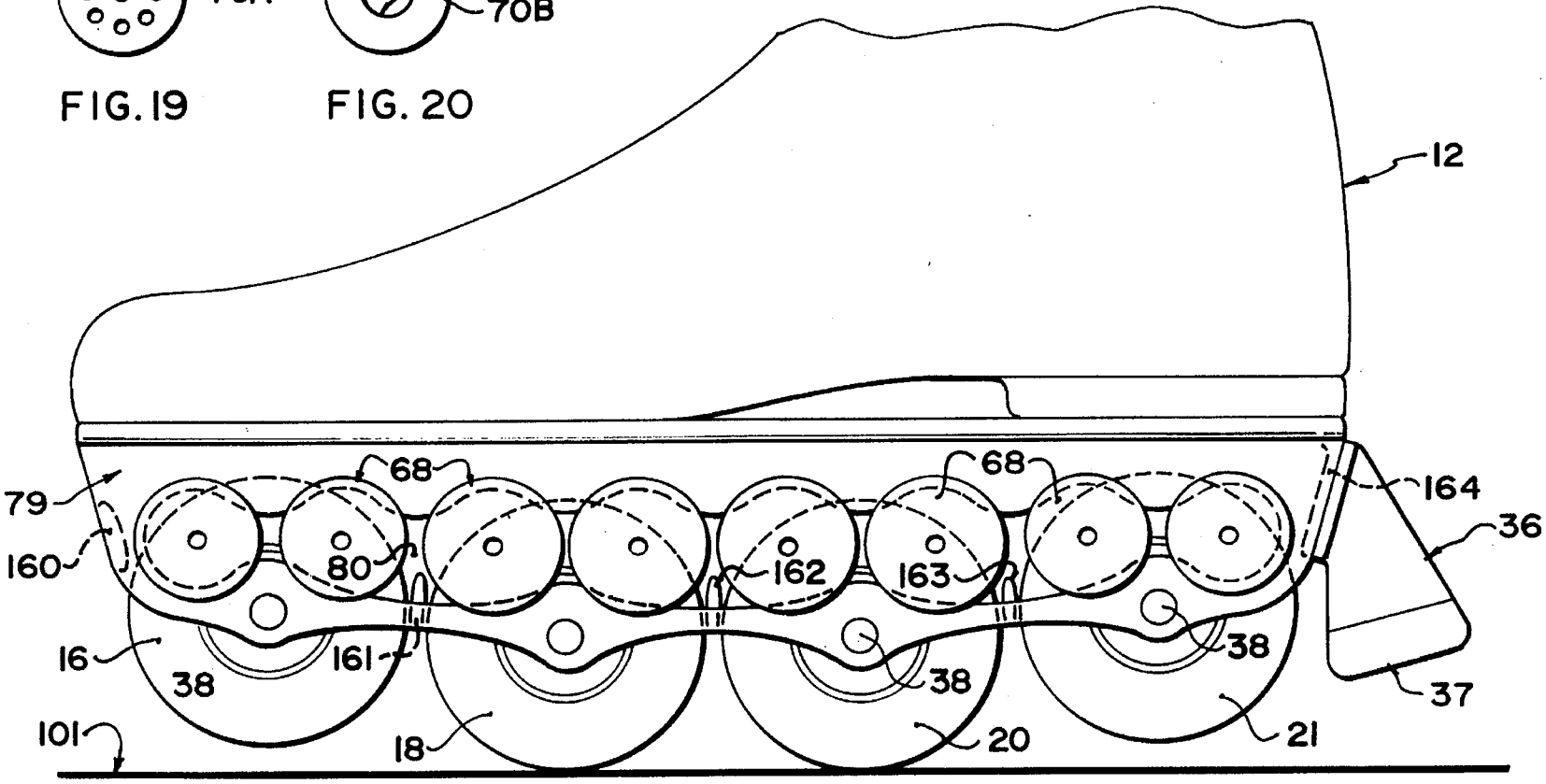
FIG. 4C illustrates a side view of a third embodiment of shock-absorbent in-line roller skate.

FIG. 4C illustrates a side view of a third embodiment of shock-absorbent in-line roller skate. As seen in FIG. 4C, the four wheels 16, 18, 20 and 21 are arranged in an arc configuration so, in the embodiment shown in FIG. 4C, only the two centre wheels 18 and 20 touch the ground 101. In certain instances, for example, increased maneuverability, may be desirable to have the forward wheel 16 and the rear wheel 21 raised above the two middle wheels 18 and 20. The forward wheel 16 and the rear wheel 28 would then only contact the ground under certain conditions. The side rail position linking the axles 38 can be designed to have a vertical bowing action, and a relatively rigid linear configuration. This region of the rail 79 can be post-tensioned or pre-tensioned, as required, in order to accommodate the elasticity of the discs 68.

As seen in FIG. 4C, the side rail 79, rather than having formed therein a series of four dumbbell openings, has formed therein a single continuous undulating "string of beads" type opening, in which the spring discs 68 are fitted. The discs 68 can have uniform or varying degrees of elasticity as required to provide the proper shock absorbency action. The central discs can be of a larger diameter than the end discs. As with the design illustrated previously in FIG. 4, there is a pair of spring discs 68 for every wheel and axle combination. Again, the side rails 58 and 56 (not visible) are formed of appropriate resilient material to provide a certain amount of flexibility, so that the dimensions of the continuous undulating opening 80 will compress upwardly to a certain extent, when the wheels 16, 18, 20 and 21 impact the ground. The compression action of the opening 80, however, is controlled both by the degree of resiliency of pre or post-tensioning of the linking area between the axles 38 and by the degree of compressibility provided by the spring discs 68. FIG. 4C also illustrates in dotted lines lateral stabilizer webs 160, 161, 162, 163 and 164, which give lateral stability to the rails 79.

Figures 4D, 21, 22:
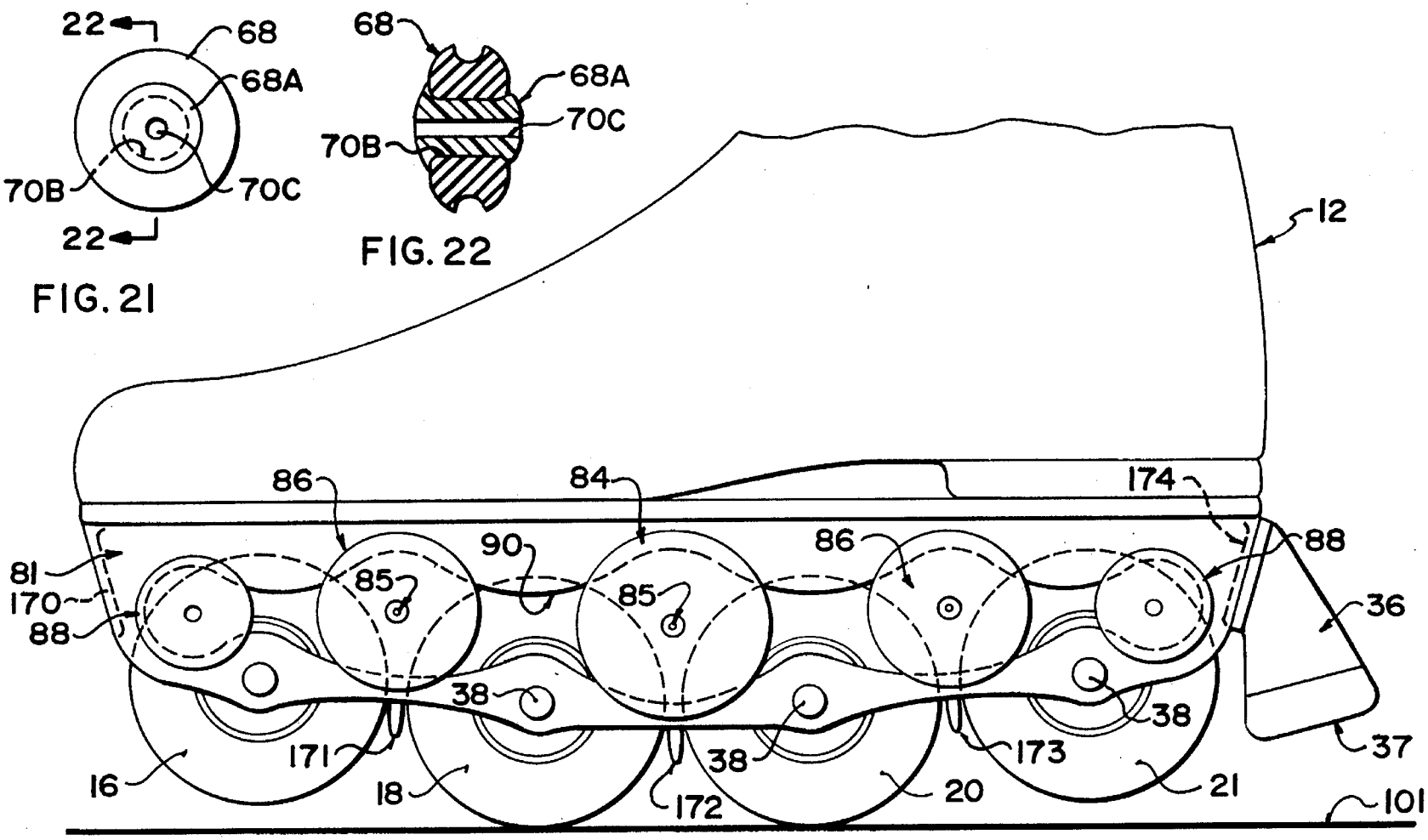
FIG. 4D illustrates a side view of a fourth embodiment of shock-absorbent in-line roller skate.
FIG. 21, which appears on the same sheet of drawings as FIG. 4D, illustrates a means of adjusting the density of the disc of FIG. 20.
FIG. 22 illustrates a section view taken along section line 22—22 of FIG. 21.

FIG. 4D illustrates a side view of a fourth embodiment of shock-absorbent in-line roller skate. The design illustrated in FIG. 4D is similar to a certain extent to that illustrated in FIG. 4C, except that the undulating opening 90, is formed (or deformed by pre- or post-tensioning) so that it accommodates significantly different sizes of spring discs. Also, the middle three discs 86 as seen in FIG. 4D have air valves so that the internal air pressure can be adjusted. As seen in FIG. 4D, there are five spring discs, arranged so that they fit on the outsides and the interiors of the four axles of the four wheels 16, 18, 20 and 21. A single large size hollow air filled spring disc 84 is fitted into the central portion of the opening 90, between the middle wheels 18 and 20. A pair of medium size air filled spring discs 86, are fitted between the two forward wheels 16 and 18, and the latter two wheels 20 and 21. A pair of small exterior spring discs 88, are fitted in the two ends of the opening 90. The action provided by the embodiment illustrated in FIG. 4D is similar to that provided by the previous embodiments, but represents a alternative means of achieving the shock absorbent, compressible wheel design provided by the invention. As illustrated, spring disc 85 and discs 86 are oversized to lower the centre wheels 18 and 20 relative to wheels 16 and 20, to provide a convex curved ground contacting wheel bottom profile, but may be replaced with smaller discs to allow all wheels to contact the ground simultaneously. FIG. 4D also illustrates lateral stabilizer webs 170, 171, 172, 173 and 174.

Figure 4E:
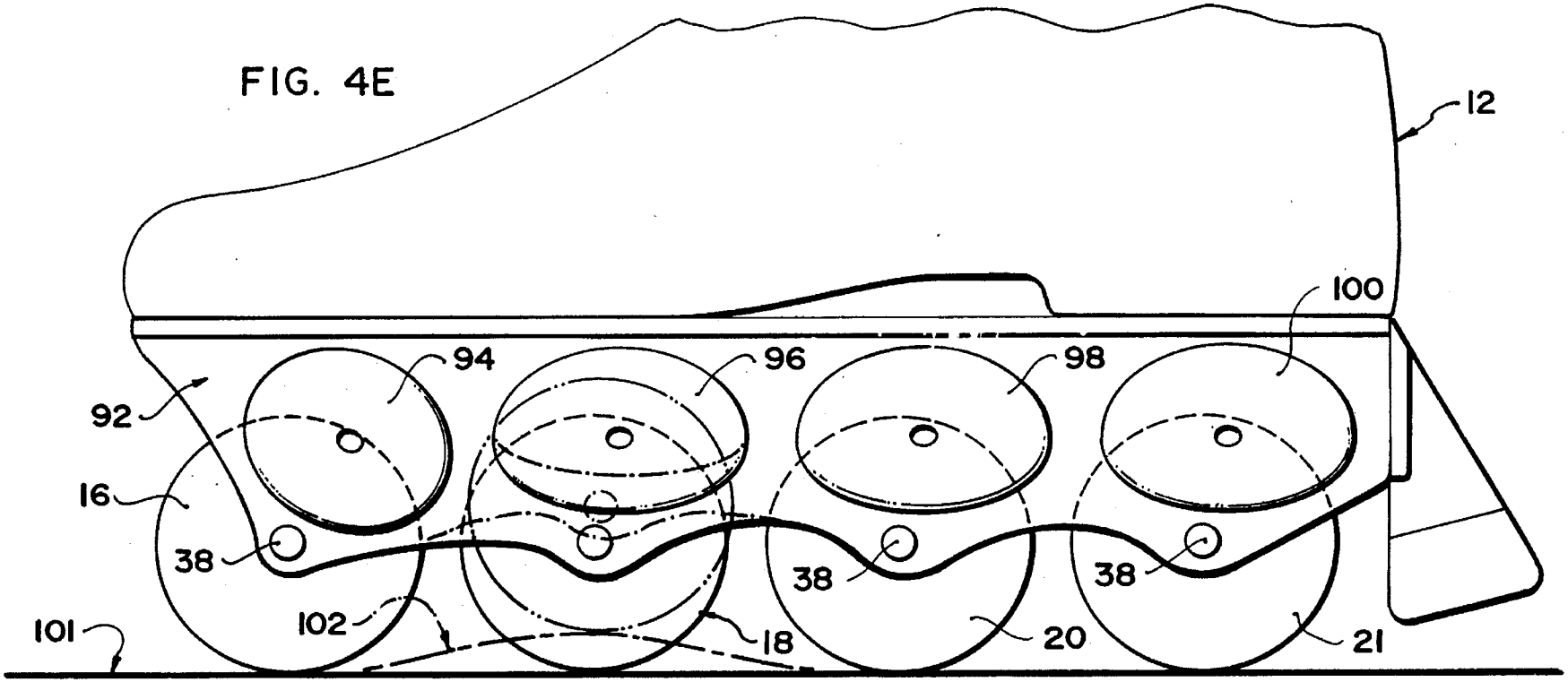
FIG. 4E illustrates a side view of a fifth embodiment of shock-absorbent in-line roller skate.

FIG. 4E illustrates a side view of a fifth embodiment of shock-absorbent in-line roller skate. As seen in FIG. 4E, four discs, 94, 96, 98 and 100, are fitted in oval openings formed in side rail 92. The four discs, 94, 96, 98 and 100 are positioned above and slightly to the rear of the respective axles 38 of the respective wheel 16, 18, 20 and 21. However, to provide the shock absorbing capacity along the force line that would be generated by wheel 16 impacting a bump, or the like, the front spool 94 is positioned slightly farther behind axle 38 of front wheel 16, than with the other three discs.

FIG. 4E illustrated by means of dashed lines 102, the manner in which wheel 18 reacts when it impacts a bump indicated by dashed line 102. The wheel 18 moves upwardly, thereby compressing disc 96, into a more oval shape configuration. A resiliency of the disc 96 absorbs the upward compressive force, and thereby enables wheel 18 to negotiate the bump 102 readily. The wheels 16, 18, 20 and 21 provide independent suspension because they all act independently as the bump 102 moves under each wheel.

FIG. 4F illustrates an isometric view of resilient shock absorbent spring disc 68. The spring disc 68 has a general disc-like configuration, with a peripheral groove 78 around its circumference. Disc opening 70 is also indicated in the central area of the spring disc 68, and penetrates through the interior of the spring disc 68. This opening 70 can vary in size in order to regulate the degree of elasticity of the disc 68. It can also be used to receive plug remover 69 for installation or removal on the skate rail.

FIG. 4G illustrates a partial section view of an embodiment of the invention with air-filled discs. The discs 77 are at an angle to avoid any interference with wheel movement under severe compression. The discs 77 are hollow so that they can be air filled via valves 85. The air can be pumped in by pump 78 and needle 83. The manner in which the discs compress when wheel 16 contacts a bump 102 is indicated in dashed lines. The pump 78 can be of small size and clamped to or incorporated in boot 12.

Figure 5A:
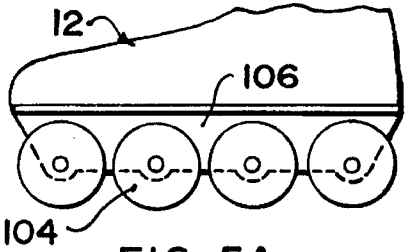
FIG. 5A illustrates a side view of the dual wheel in-line roller skate illustrated in FIG. 5.
Figure 5:
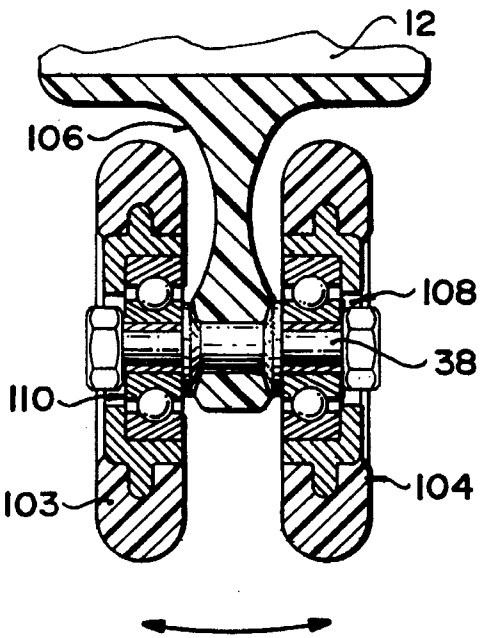
FIG. 5 illustrates an end section view of a first embodiment of a lateral dual wheel in-line roller skate.

FIG. 5 illustrates an end section view of a dual wheel in-line roller skate. The boot 12 as seen in FIG. 5 has on the underside thereof two parallel rows of wheels 102 and 104 mounted by axle 38 to a central mount 106. This dual wheel in-line roller skate design is also adapted to absorb shocks and bumps as will be explained below.

In the end section view illustrated in FIG. 5, the first wheel 102 is paired with a second wheel 104, both of which are rotatably mounted on a common axle 38, and are rotatable about respective ball bearings 108 and 110. The pair of wheels 102 and 104 are fixedly mounted on a central dual wheel mount 106, which is secured to the undersigned of the boot 12. The central dual wheel mount 106 is constructed, such as by extrusion molding, from a strong semi-rigid material which has a certain amount of lateral "give" to it. The degree of stiffness of the material from which the wheel mount 106 is constructed can be varied as required. Reinforcing with glass or graphite fibres may be advisable. FIG. 5A illustrates a side view of the dual wheel construction with four pair of wheels 102 mounted in spaced relation rotatably on central dual wheel mount 106, which is secured to the underside of boot 12.

As indicated by the double ended arrow in FIG. 5, the pair of wheels 102 and 104 can move laterally due to the semi-flexibility of the central dual wheel mount 106. This action enables each wheel 102 and 104 to negotiate individually a bump or an obstruction. The result is that the four pair of wheels on the skate (see FIG. 5A) are adapted to yield to obstructions on the surface over which the skater is travelling.

Figure 6A:
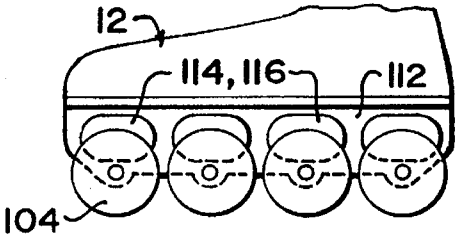
FIG. 6A illustrates a side view of the dual wheel in-line roller skate illustrated in FIG. 6.
Figure 6:
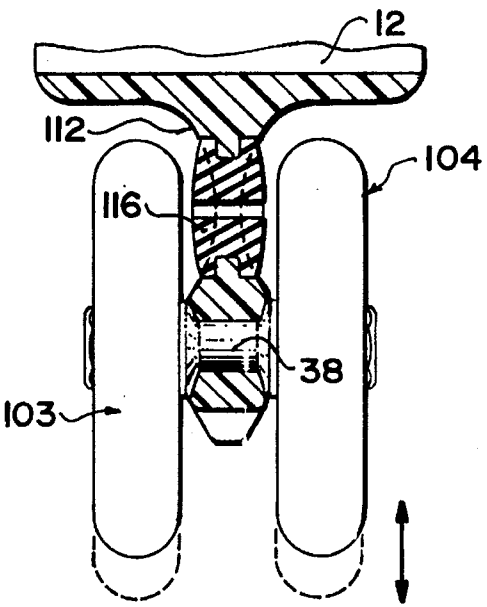
FIG. 6 illustrates an end-section view of a second embodiment of a lateral dual wheel in-line roller skate.

FIG. 6 illustrates and end section view of the second embodiment of the dual wheel in-line roller skate. FIG. 6A illustrates a side view of the dual wheel in-line roller skate illustrated in FIG. 6. The dual wheel design illustrated in FIGS. 6 and 6A vary from that illustrated in FIGS. 5 and 5A in that the central mount 112 has formed therein a plurality of openings 114, into which can be fitted resilient spring discs 116. The action provided by this combination is similar to that described previously for the openings and the spring disc combinations described for the single in-line roller skate designs illustrated in FIGS. 4, 4A, 4B, 4C, 4D, 4E, 4F and 4G.

The configuration illustrated in FIG. 6 and 6A enables lateral movement and vertical wheel movement to be achieved, as indicated by the pair of double headed arrows.

Figure 7A:
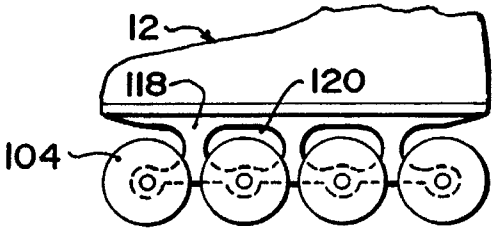
FIG. 7A illustrates a side view of the dual wheel in-line roller skate illustrated in FIG. 7.
Figure 7:
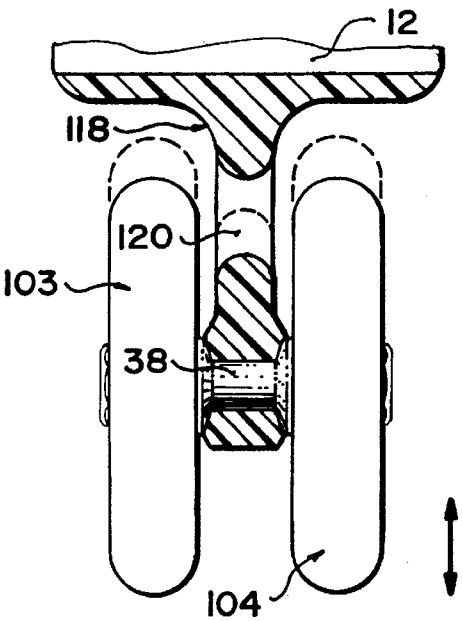
FIG. 7 illustrates a end-section view of a third embodiment of a lateral dual wheel in-line roller skate.

FIG. 7 illustrates an end section view of a third embodiment of a dual wheel in-line roller skate. FIG. 7A illustrates a side view of the roller skate design illustrated in FIG. 7. In this design, the central wheel mount 118 has an "open-ended" design, with two central openings 120. This design also has lateral and vertical dual wheel movement, as indicated by the pair of double headed arrows in FIG. 7. The material from which central mount 118 is constructed can be selected to provide the requisite amount of flexibility and shock absorbing capacity. A semi-rigid resilient plastic material such as density polyethylene, high density polypropylene, suitable reinforced with fibreglass or graphite filaments, or the like, can be utilized.

The three embodiments of dual wheel in-line roller skate design illustrated in FIGS. 5, 5A, 6, 6A, 7 and 7A show the wheels mounted in pairs. In each case, the pair of wheels can move upwardly or downwardly by compressing the openings or in a lateral direction about the central dual wheel mount which is constructed of a suitable resilient material.

Most bumps and obstructions encountered by a skater as he or she skates over the ground are not very large and accordingly it is unlikely that each of the dual wheels will encounter the same bumps simultaneously. Thus, when one of the dual wheel pairs encounters a bump, it is able to move upwardly relative to the other dual wheel, and thereby absorb at least a portion of the impact caused by the bump. The pair of wheels are also able to move laterally. This pivotal dual wheel configuration provides a more smooth operating and shock absorbing in-line skate design, than the conventional in-line roller skate design where the wheels are rigidly mounted to the frame.

With the dual wheel mounting, one or both of the wheels are free to move upwardly against the compression force exerted by the central mound, with or without spring discs, when one or both wheels encounter a bump or obstruction the ground surface over which the skater is skating. This construction provides a very smooth operating dual wheel in-line roller skate. Furthermore, when the skater negotiates a turn, and "leans" into the turn, the wheel mounting flexes somewhat and enables the inner wheel to yield more than the outer wheel, as the case may be, thereby enabling all wheels to remain in contact with the ground surface, even though the skater is leaning into the turn.

Figure 8:
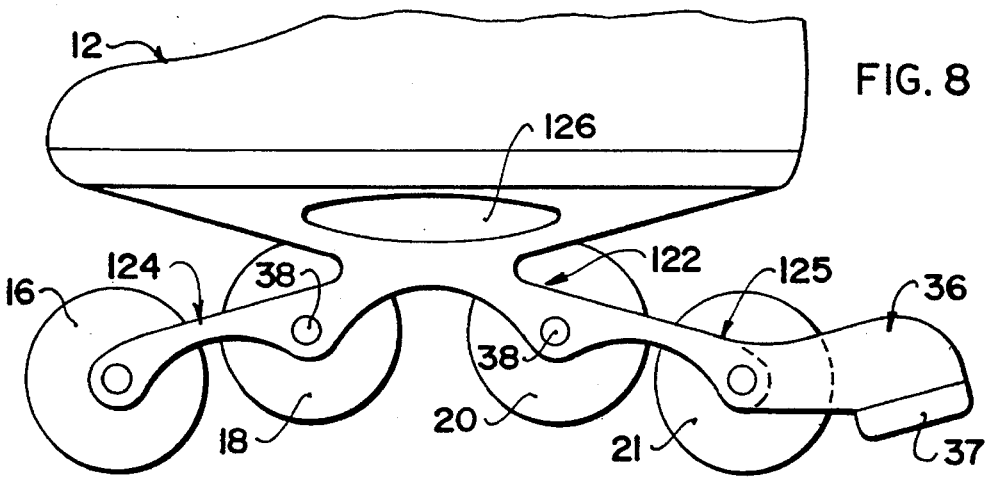
FIG. 8 illustrates a side view of an in-line roller skate with spring yoke wheel suspension.

FIG. 8 illustrates a side view of an in-line roller skate with spring yoke wheel suspension, shown in an unstressed condition. In this design, the four wheels 16, 18, 20 and 21, are mounted on a yoke-like wheel suspension 122, which is secured to the underside of the boot 12. FIG. 8 illustrates the arrangement the wheels and the yoke 122, which is constructed of a semi-ridge spring-line resilient material, such as flexible metal alloys, graphite fibre, or similar material, used in bicycle forks and frames, tennis rackets, or similar sports equipment constructions. The front pair of wheels 16 and 18 are mounted on the forward portion 124 of the yoke. Wheels 20 and 21 are rotatably mounted on the rear portion of the yoke 122.

Figure 8A:
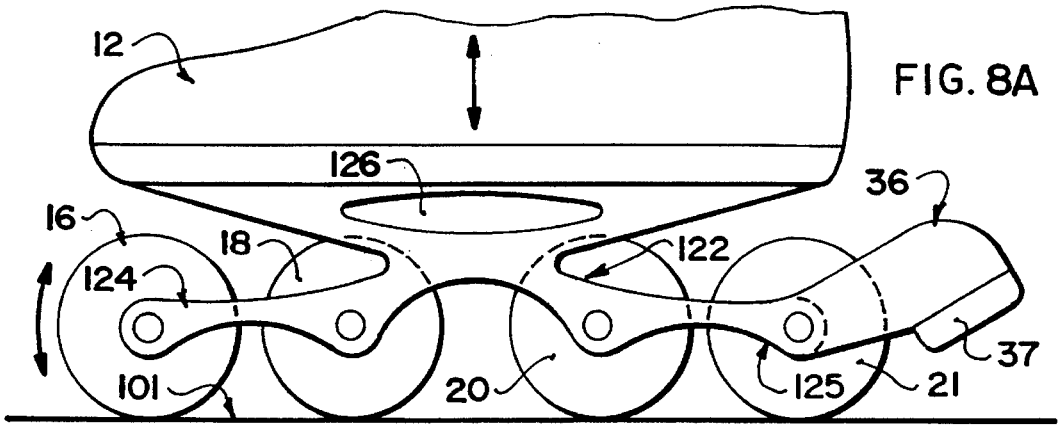
FIG. 8A illustrates a side view, of an in-line roller skate with spring yoke wheel suspension, when contacted with the ground and under a limited load.
Figure 8B:
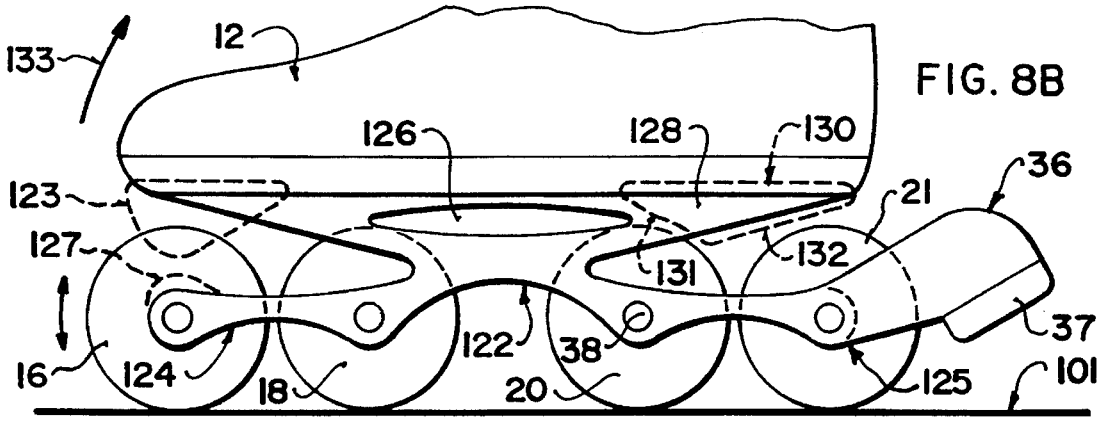
FIG. 8B illustrates a side view of an in-line roller skate with spring yoke wheel suspension, when subjected to further ground compression action, compared to the configuration illustrated in FIG. 8A.
Figure 11:
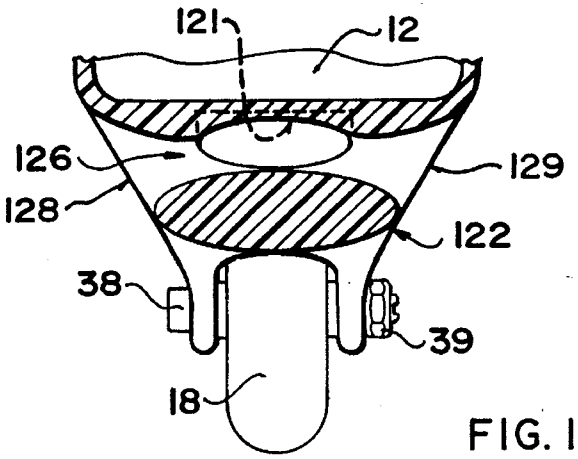
FIG. 11 illustrates a section view taken along section line 11—11 of FIG. 9.

When the skater wearing the boot 12, contacts the ground, the forward and rear arms 124 and 125 of the yoke 122 yield upwardly as illustrated in side view perspective in FIG. 8A. This action is illustrated by the vertical double headed arrow on boot 12. As the skater applies more weight, the yoke 122, by means of the compression action provided by elongated oval opening 126, provides further shock absorbing and compression force absorbing action as seen in FIG. 8B. FIG. 8B illustrates in dotted lines an optional set of upper and lower front bumpers 123 and 127 which prevent the forward wheel 16 from bumping and stalling against the underside of boot 12, when wheel 16 encounters a large bump. As shown in FIG. 11, the upper front graded bumper 123 can be inserted into a socket 121 formed between side rails 128 and 129 and below boot 12.

FIG. 8B also illustrates in dotted lines a wedge-like graded braking pad 130 which may be inserted into a rear socket under the heel of the boot 12 similar to socket 121. As viewed in FIG. 8B, the graded braking mechanism acts as follows: When the toe of the boot 12 is rotated upwardly, as shown by upward arrow 133, initial braking commences when third wheel 20 contacts surface 131 of the pad 130. This begins to apply a mild braking action to wheel 20 while still allowing contact of front toe wheel 16 and second wheel 18 with the ground surface. Further upward rotation of the toe of the boot 12 increases the braking action applied to wheel 20 and initiates braking action between under surface 132 of pad 130 and wheel 21. Meanwhile, toe wheel 16 remains in ground contact permitting continued directional control. Continued upward toe rotation, in the direction of arrow 133, finally engages brake pad 37 with the ground surface 101. This also applies progressively more braking force to wheels 20 and 21 and in combination increases overall braking effectiveness. Bumper 123 and brake pad 130 can be removably replaced with similar shaped elements of varying physical characteristics of elasticity and wear. The in-line roller skate design illustrated in FIG. 8, 8A and 8B by selecting the appropriate constructing material for the yoke 122, can provide a cushioning-type action to the skate.

Figure 9:
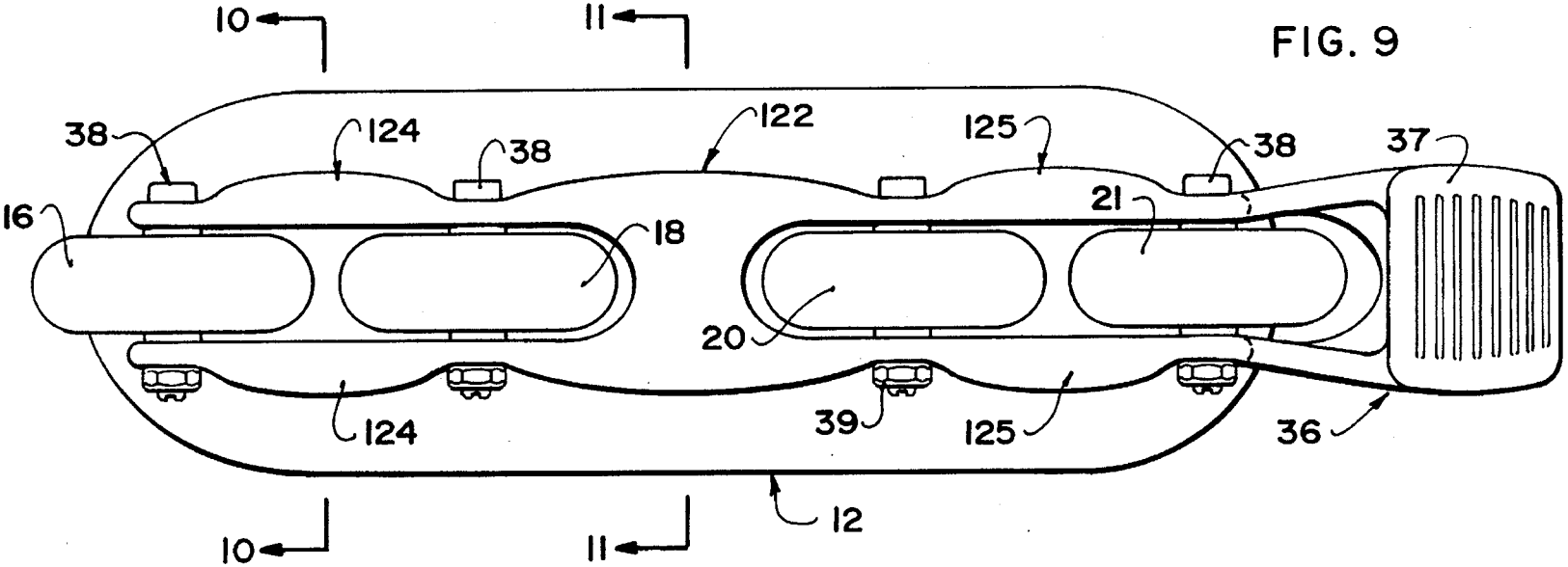
FIG. 9 illustrates a bottom view of an in-line roller skate with spring yoke wheel suspension.

FIG. 9 illustrates a bottom view of an in-line roller skate with spring yoke wheel suspension, as illustrated FIGS. 8, 8A and 8B. The forward arm 124 of the yoke and the rear arm 125 of the yoke 122 are forked, thereby providing openings in the interior in which the wheels 16, 18, 20 and 21 can be rotatably mounted respectively by axles 38.

Figure 10:
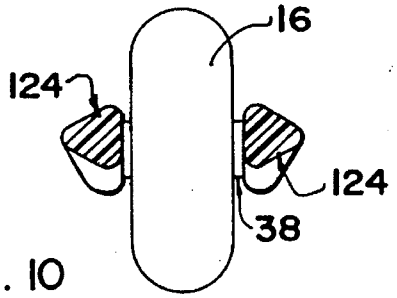
FIG. 10 illustrates a section view taken along section line 10—10 of FIG. 9.

FIG. 10 illustrates a section view taken along section 10—10 of FIG. 9. The wheel 16 is shown rotatably mounted on axle 38, which is held by forward yoke arm 124. FIG. 11 illustrates a section view taken along section 11—11 of FIG. 9. Wheel 18 is rotatably mounted on axle 38, nut 39 combination, which is mounted in yoke 122. The opening 126 is also indicated. The yoke 122 is secured to the underside of the boot 12.

Figure 12:
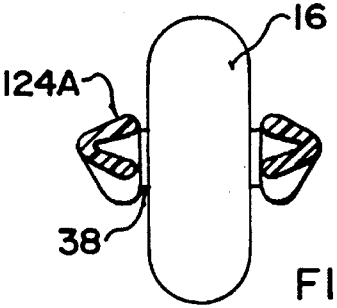
FIG. 12 illustrates a section view taken along section line 10—10 of FIG. 9 of an alternative embodiment of hollowed-out lightweight yoke supports.

FIG. 12 illustrates a section view taken along section line 10—10 of FIG. 9 with an alternative embodiment of hollowed-out lightweight yoke supports. The yoke supports 124A are constructed of strong, lightweight, resilient material and are hollowed out to reduce weight while maintaining lateral rigidity and allowing resilient vertical movement to carry axle 38 and wheel 16.

Figure 13:
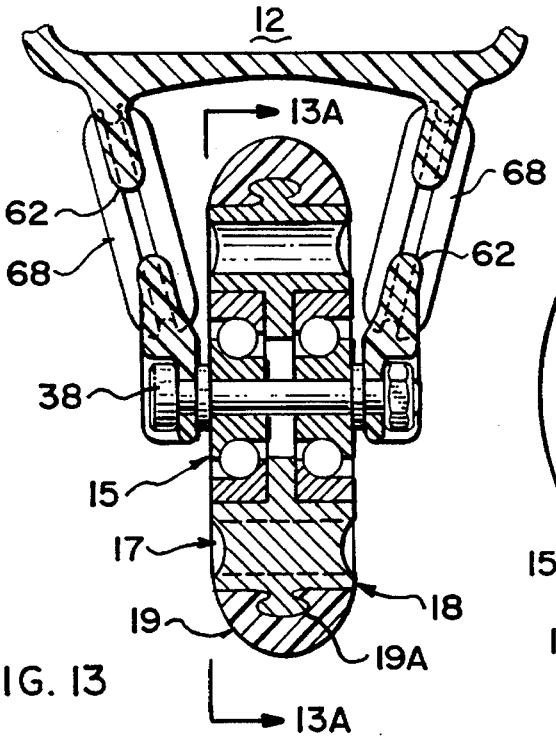
FIG. 13 illustrates a section view taken along section line 13—13 of FIG. 4, showing a lightweight wheel assembly with a low profile tire.

FIG. 13 illustrates a section view taken along section line 13—13 of FIG. 4. The section line 13—13 passes through the narrowest part of the dumbbell shaped disc receiving cavity 62. This central portion of the opening 62 serves as a bumper preventing wheel contact with the sole plate of the boot 12 thereby avoiding inadvertent braking of the wheels in extreme situations. FIG. 13 shows inter alia a lightweight composite wheel 18, including a metal or plastic bearing housing hub, spoke and rim element 17 mounting a ground engaging tire 19 of low profile with good wear characteristics. The spokes serve to lighten the weight of the wheels. They also serve to conduct unwanted heat away from the circumference of the wheels, axles and bearings by allowing circulating air between the radial spoke members. The tire is mounted on the rim element 17 which may include a tire engaging annular ring 19A. As the shock absorption in taken within the rail members, and/or the elements 17, if constructed of resilient material, the tires 19 may be constructed of generally firm material such as hard rubber or plastic such as polyurethane, neoprene, or polybutadiene. In extreme situations the tire compound may even include imbedded hard particulates or grit for grip on slippery surfaces such as ice. The particulates may be coarse or fine and of metal, sand or other suitable friction enhancing materials.

Figure 13A:
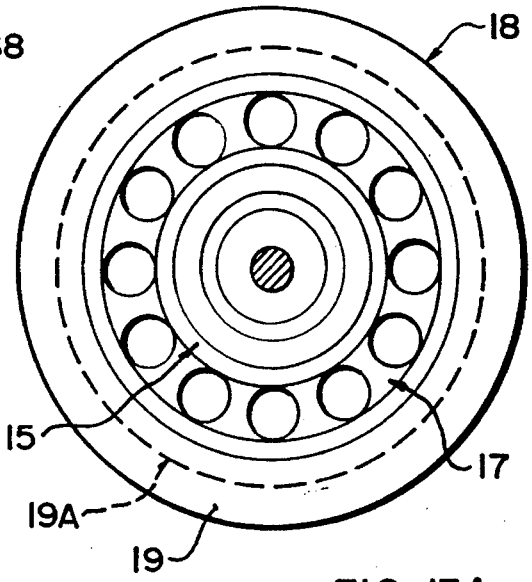
FIG. 13A illustrates a view of the wheel of FIG. 13 taken along section line 13A—13A of FIG. 13.

FIG. 13A illustrates a side view of a wheel 18 with the vented spokes in the element 17 mounting the bearings 15 and tire 19. The position of the annular tire anchoring ring 19A is shown in dotted lines. The ring 19A aids in bonding the tire 19 to the rim of wheel element 17. Adhesive may be used. Referring to FIG. 15, bonding may be further enhanced through boring of a plurality of radial spaced apart holes 17A, in the rim of element 17 and spaced apart annular holes 19B, in tire anchor 19A.

Figure 14:
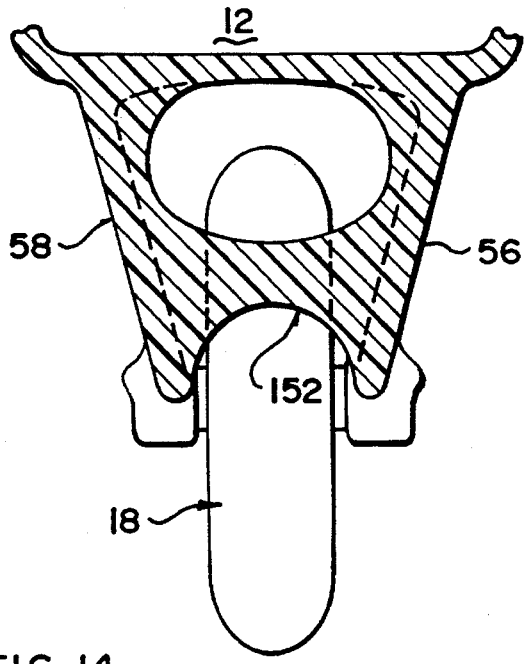
FIG. 14 illustrates a section view taken along section line 14—14 of FIG. 4, showing a lateral stabilizer web in the wheel support rail.

FIG. 14 illustrates a section view taken along section line 14—14 of FIG. 4, showing a lateral stabilizer web 152. These stabilizer webs 150, 151, 152, 153, and 154 can be hollow, semi-hollow or of a lattice structure to reduce weight, and lend lateral stability to the side rails and prevent wander, wiggling or wobbling of the in-line wheels.

FIG. 15 illustrates a section view of an in-line roller skate wheel and support with axle-mounted resilient shock absorbing axle plug. As seen in FIG. 15, a pair of resilient shock absorbing plugs 200 are positioned between the wheel supporting rails 202 and a pair of respective spacer sleeves 204 which fit over the axle 206 at each end. The plugs 200 are confined at the opposite side by respective washers 208. The sleeves 204 and washers 208 have extended vertical flanges 205 and 209 respectively which contain the plug member 200 and can be constructed of a suitable lightweight plastic such as polyethylene or metal such as aluminum. This construction enables the axle 206 to yield upwardly to bumps and obstructions to which the wheel may be subjected when the skater is traversing over uneven terrain.

Figure 15A:
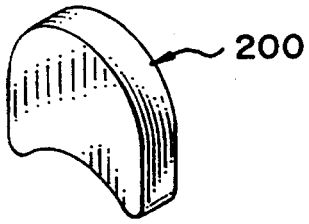
FIG. 15A, which appears on the same sheet of drawings as FIGS. 13 and 14, illustrates an isometric view of a resilient shock absorbing axle plug.

FIG. 15A, which appears on the same sheet of drawings as FIGS. 13 and 14, illustrates an isometric view of a resilient shock absorbing axle plug 200. The plug 200 has a basic crescent shape and is constructed of suitable resilient material. The degree of resilience can be selected to accommodate the degree of shock absorbing ability desired.

Figure 15B:
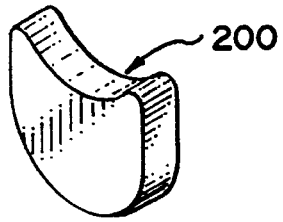
FIG. 15B, which appears on the same sheet of drawings as FIGS. 13 and 14, illustrates an isometric view of an inverted shock absorbing axle plug.
Figure 15:
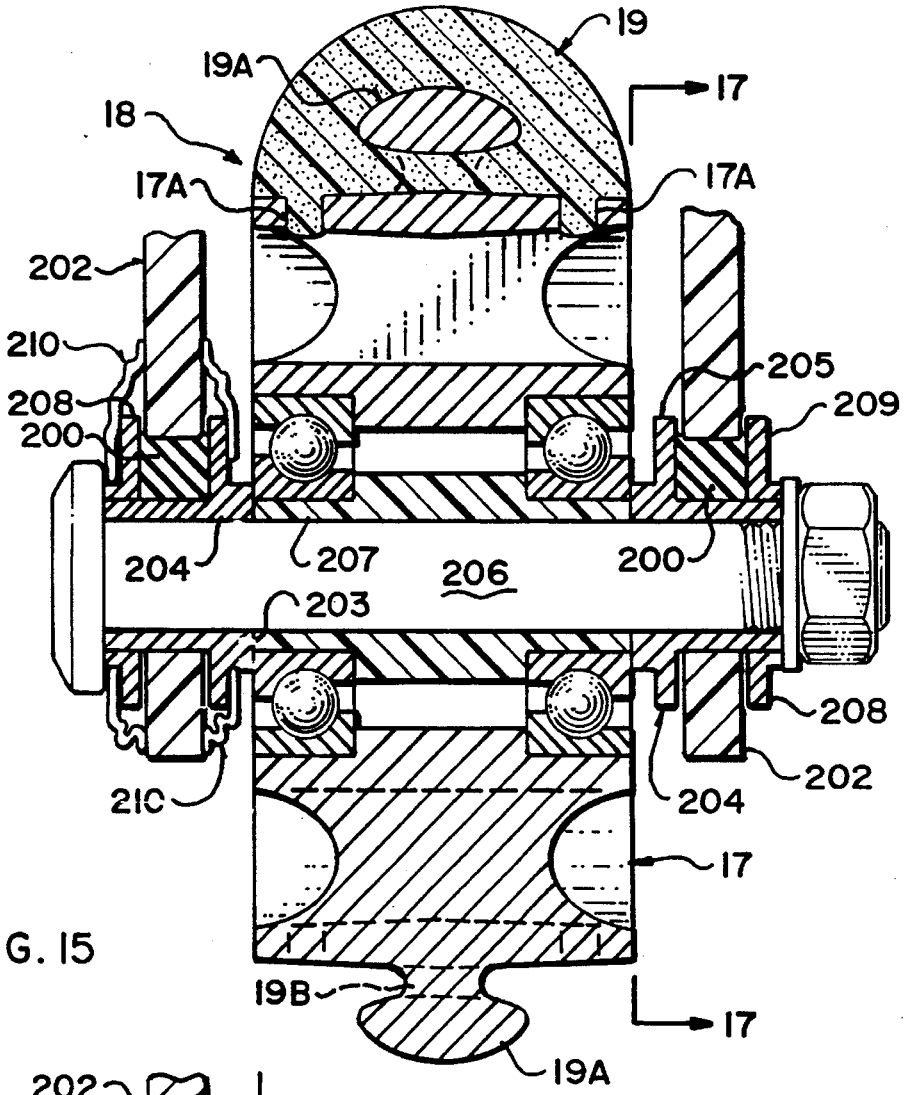
FIG. 15 illustrates an enlarged section view of an in-line roller skate wheel and support with a pair of axle-mounted resilient shock absorbing axle plugs and tire mounting means.

FIG. 15B, which appears on the same sheet of drawings as FIGS. 13 and 14, illustrates an isometric view of the axle shock absorbing plug 200 in inverted configuration. In certain situations, it may be desirable to raise the elevation of the axle 206 and this can be done by inverting the two plugs 200 and placing them beneath the axle 206.

Figure 16:
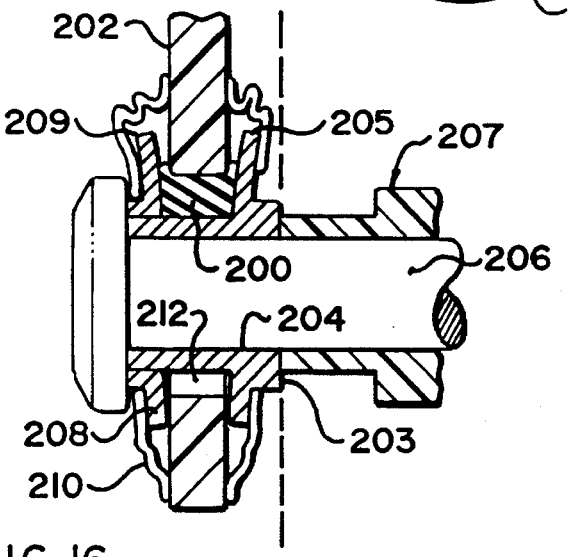
FIG. 16 illustrates a section view of a detail of the axle and resilient shock absorbing axle plug of FIG. 15 under compression.

FIG. 16 illustrates a section view detail of the axle and resilient shock absorbing plug of FIG. 15 under compression. In this view, the vertical movement of the axle 206 in the vertical slot 212 is evident. The plug 200 is compressed and thus permits the axle 206 to yield upwardly. Alignment of plug enclosing flanges 205 and 209, and of spacer 204 and washer 208 respectively, may be accomplished by using a splined bore in washer 208 thereby interfacing matching splines on spacer 204. End face 203 may have splines (not shown) which mate with matching splines (not shown) at the interface with bearing spacer 204. Axle 206 may be shaped to prevent rotation within the axle slot 212. An optional protective dust cover 210 can be installed.

Figure 17:
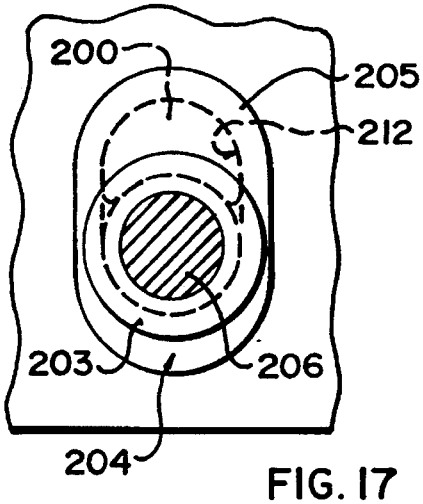
FIG. 17 illustrates a section view taken along section line 17—17 of FIG. 15.

FIG. 17 illustrates a section view taken along section line 17—17 of FIG. 15. This view reveals an end elevation of the spacer 204 with its vertical plug containment flange 205. During impact with a bump, axle 206 and spacer sleeve 204 move upwardly, within slot 212, thereby compressing plug 200 and absorbing shock.

FIG. 18, which appears on the same sheet of drawings as FIG. 4, illustrates a second embodiment of shock absorbing wheel. In this view, the wheel 18 has angled resilient spokes 17, which yield under force and enable the wheel 18 to absorb compression forces. The spokes 17 can be formed of a resilient elastic shock absorbing material such as rubber or plastic, while the wheel circumference can be formed of a wear resistant ground gripping material such as polyurethane.

Figure 19:
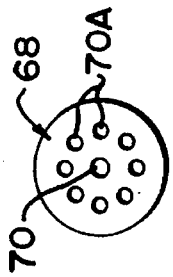
FIG. 19, which appears on the same sheet of drawings as FIG. 4C, illustrates a means of varying disc density.

FIG. 19, which appears on the same sheet as FIG. 4C, illustrates a means of controlling the resiliency of disc 68 by adjusting density using a plurality of holes 70A in addition to central hole 70. Although not shown these holes may be retroactively filled with a suitable filler to increase density.

Figure 20:
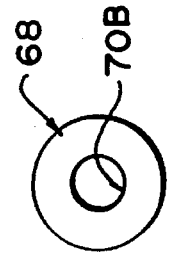
FIG. 20 illustrates a further means of varying disc density.

FIG. 20 illustrates a further means of varying resiliency by using a larger diameter cavity 70B in the disc 68.

FIGS. 21 and 22, which appear on the same sheet as FIG. 4D, illustrate in front and section view a means of adjusting the resiliency of the disc 68 in FIG. 20 by retrofitting a further plug 68A of some determined density into bore 70B. The plug 68A may be press fitted into bore 70B or be removed using a tool 69, as described earlier. Disc 68 may subsequently be removed by using a finger which is inserted into bore 70B and then is used to pry out the disc.

Figure 23:
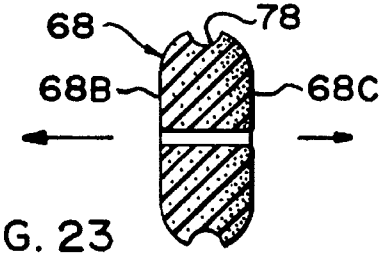
FIG. 23, which appears on the same sheet of drawings as FIG. 4E, illustrates a graded density disc.

FIG. 23, which appears on the same sheet as FIG. 4E, illustrates a disc member 68 of graded density where side 68B is more resilient than side 68C. This causes the softer side 68B to bulge out more than the stiffer side 68C under compressive forces. Side 68B can be orientated to the outside of the skate whereas side 68C can face the inside adjacent the wheels. Side 68C can thus be designed to avoid abrasive contact with the wheels.

Figure 24:
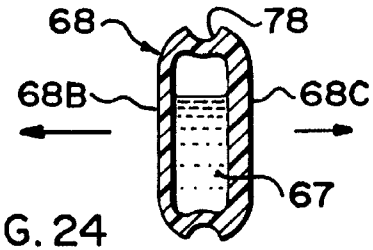
FIG. 24 illustrates an asymmetrically resilient fluid filled disc.

FIG. 24 illustrates a further embodiment where the disc 68 may be filled with a fluid 67. The side walls 68B and 68C are dimensioned to avoid abrasive wheel contact.

Figure 25:
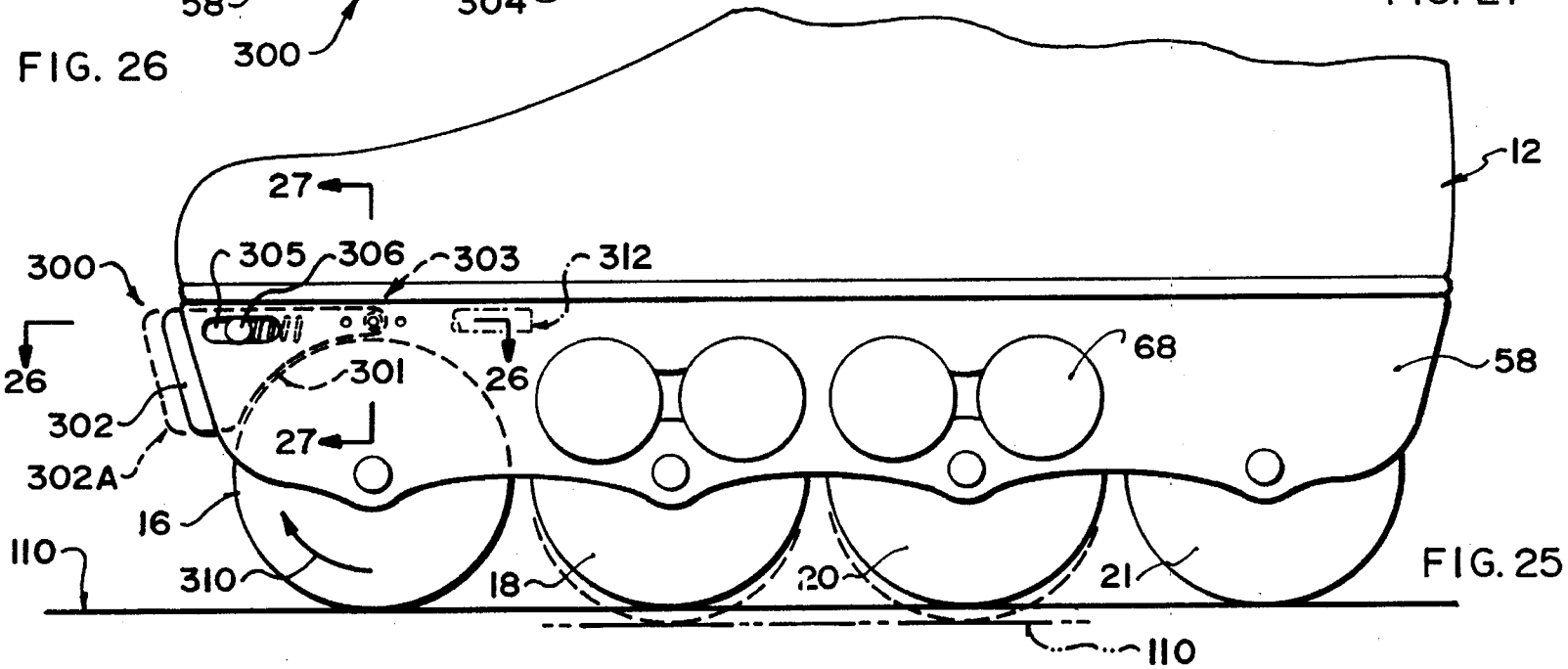
FIG. 25 illustrates a side view of a partially shock-absorbent in line skate with a releasable toe wheel lock.

FIG. 25 illustrates a further embodiment of a shock-absorbent in-line roller skate where only the centre wheels have resilient members over their respective axles. In this embodiment, the initial shock encountered by the first wheel 16 (in forward motion) encountering a bump is dampened by the foot of the skater as the toe pivots upward about the ankle of the skater over the bump. The second and third wheels, 18 and 20, absorb the shock of the bump in turn by displacing or compressing their respective resilient members 68. This allows the toe wheel 16 to recontact the surface 110 thereby allowing the toe wheel 16 to be used for directional control, while the following wheels negotiate the bump in turn and absorb shock. The rear wheel 21 absorbs the shock of the bump generally by the action of the skater's knee. FIG. 25 further shows the ability of the embodiment to adjust relative wheel height. Insertion of larger or stiffer members 68 over the axles of the middle wheels 18 and 20 will tend to downwardly extend the wheels along the dashed lines shown below the wheels 18 and 20 thereby allowing for alternative skating styles as is known in the in-line skating art.

FIG. 25 also illustrates a removable and replaceable to forward wheel lock mechanism 300 which can be used to lock the wheel 16 in a wedging manner, between the wheel and the bottom of the sole plate of the boot 12. This locking action can be used to facilitate climbing a slope or negotiating stairs and the like. In operation, the inverted concave saddle shaped surface 301 of the mechanism 300 is tapped rearwardly into frictional engagement with the toe wheel 16 by striking the head 302 of the mechanism against the ground, or against some suitable vertical abutment, prior to initiating a climb up a set of stairs or a slope. The rearward position of the mechanism 300 prevents the wheel 16 from rotating in a clockwise direction, as indicated by arrow 310 in FIG. 25. This allows the skater to use the stationary wheel 16 to gain a purchase in climbing. It is not therefore necessary to revert to the common method of sidestepping uphill or upstairs which is awkward, slow and becomes particularly precarious when negotiating stairs. Increasing clockwise force on the wheel 16 due to the climb will be resisted by automatically increasing wedging action.

Briefly, returning to FIG. 8B, it will be understood that the bumper 123 illustrated in FIG. 8B may be replaced with a similar saddle shaped wedge member slidably fitted into the socket 121 to lock the front wheel of that embodiment for climbing purposes.

Returning to FIG. 25, the lock mechanism 300 includes a detent keeper 303 which releasably engages detent holes 304 in the rail 58 in a sequential manner. The keeper 303 ensures that the lock 300 remains engaged as the clockwise force 310 is removed as each foot is successively raised in the climbing action. Alternative conventional lock mechanisms can be used, for example, a swing lever which applies a locking force to the lock mechanism 300 when rotated to a locked position.

When the climb is completed, and the skater wishes to free the wedge lock mechanism 300, the skater simply manually grasps the head 302 and pulls it forward to a disengaged detent position as indicated by dashed line 302A in FIG. 25. Advantageously, the skater may also more readily free the front wheel 16 by striking the wheel 16 forwardly along the ground in a counterclockwise direction, opposite to the arrow 310 in FIG. 25.

Figure 26:
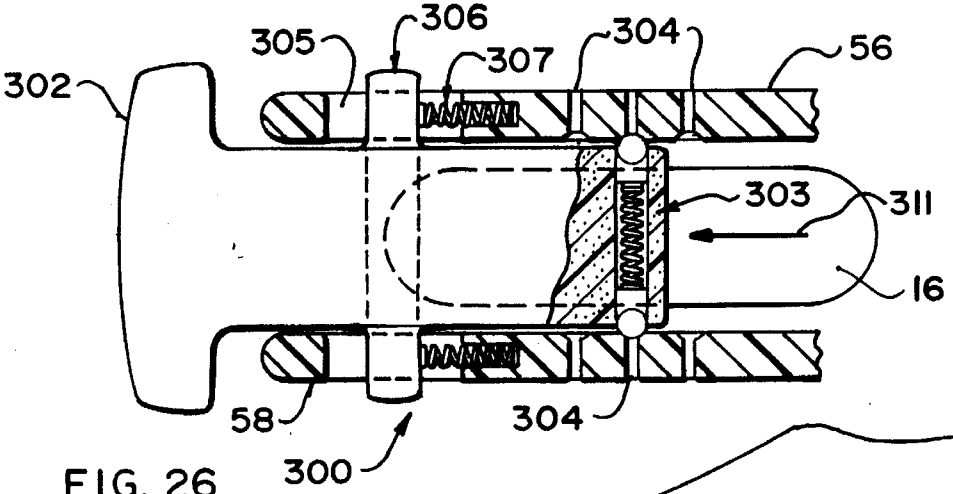
FIG. 26 illustrates a section view taken along section line 26—26 of FIG. 25.

This action may best be seen in FIG. 26 where the counterclockwise force is designated by arrow 311. The wedge 300 is forced out of the locking detent forwardly of the skate 12 with the pair of biasing springs 307 acting on the ends of the pair of retaining guide pins 306 in slots 305 which are formed in rails 56 and 58. This serves to space the under surface 301 away from the circumference of the wheel 16, and permit free rotation once again. Number 312, in FIG. 25, designates an alternative position for a single biasing spring located between the rails 56 and 58 about arrow 311, as shown in FIG. 26. The pin 306 and the detent keeper 303 also prevent the wedge 300 mechanism from resting on the wheel 16 when disengaged.

Figure 27:
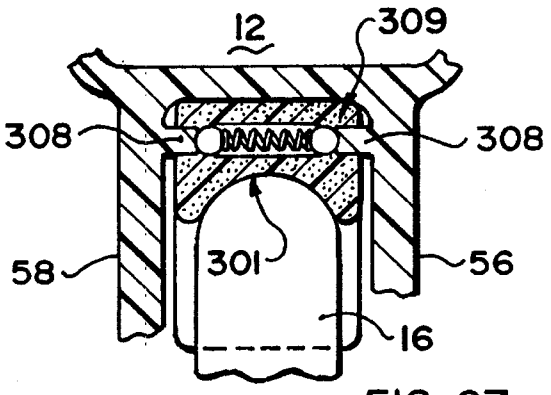
FIG. 27 illustrates a section view taken along section line 27—27 of FIG. 25.

FIG. 27 shows an alternative means of preventing wedge face 301 from riding on the wheel 16 using support flanges 308 which slidably fit in slots in the sides of the wedge member 300. In this case, a click stop detent 309 may engage recesses (not shown) on the inner faces of the flanges 308.

The wheel lock 300 may further be used as a brake while skating backwards, simply by applying the head 302 onto the ground the ground surface 110 with the wheel 16 still in touch with the ground. Progressively greater pressure applied to the head 302 will eventually act to slow the wheel 16 thereby adding to overall braking effectiveness.

Preferably each skate will have a toe wheel brake lock mechanism and, although not shown in FIG. 25, may also have a rear brake 36 as seen in previous figures.

Additionally, more than one wheel may be locked simultaneously or sequentially with a series of ganged wedge lock mechanisms. The toe lock wedge may be adapted to any of the foregoing disclosed shock-absorbing in-line skates or shaped to fit most existing conventional in-line skates.

Although the overall weight appears to increase with some combinations of resilient disc densities, and this may be of concern, this factor may be offset by the incorporation of lighter ground wheels. Resilient shock-absorbing in-line skates are of great benefit in long downhill runs where comfort is desirable and lack of control of paramount concern. On relatively slow level surfaces, lighter replaceable resilient elements may be used or the replaceable elements removed entirely dependent according to skater weight and boot rail resiliency ratios. At some ratios, the removal of a number of the resilient discs may result in the rails sagging and the wheels of the skate contacting the bottom of the boot sole plate, particularly where wheel travel limit stops are not provided. This situation can be of advantage, however, in that it would allow the skater to walk if so desired. Spare resilient members may be carried by the skater to alter the behavioral characteristics of the skate in response to varying road conditions. These shock-absorbing in-line skates may be designed for country road or limited cross country applications.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An in-line roller skate comprising:

(a) a boot with a heel and toe adapted to receive a foot of a skater;

(b) a first wheel supporting rail means secured to an underside of the boot and extending from the heel to the toe;

(c) a second wheel supporting rail means secured to an underside of the boot and extending from the heel to the toe adjacent and generally parallel to the first rail means;

(d) a plurality of wheel means mounted in tandem in a line between the first and second rail means, the wheel means being respectively connected to the first and second rail means by respective axle means and bearing means; and (e) a plurality of resilient shock absorbing means located between the respective axle means and bearing means and the rail means to enable the respective wheel means to move under force individually upwardly or downwardly relative to the first and second rail means, said resilient shock absorbing means being arranged in pairs for each wheel, axle and bearing means, and the resilient shock absorbing means being mounted in respective vertical elongated cavities in the first and second rail means, each resilient means having a crescent shape, the axle means fitting in the concave curves of the crescents whereby the axles are positioned at a first elevation when the concave sides of the crescents face upwardly and are positioned at a second lower elevation when the concave sides of the crescents face downwardly.

2. A roller skate as claimed in claim 1 wherein there are at least three wheel means and the first rail means and the second rail means include at least three respective resilient means and the at least three wheel means are rotationally mounted in the respective resilient means.

3. A roller skate as claimed in claim 1 wherein the resilient shock absorbing means are removable and invertible resilient plugs which are positioned in the respective cavity means in the first rail means and the second rail means, the resilient plugs impinging on the axle and bearing means for each respective wheel means, and absorbing compression force when the respective wheel means moves upwardly, and dispensing compression force when the respective wheel means moves downwardly.

4. A roller skate as claimed in claim 3 wherein the first rail means and the second rail means have formed therein, in association with the respective cavity means, axle wells, which permit the axles to move upwardly or downwardly in relation to the first and second rail means.

5. A roller skate as claimed in claim 1 wherein the respective resilient means are held in place by respective removable washer means which fit about the respective axle means.

6. A roller skate as claimed in claim 5 wherein the respective resilient means are held in place by respective spacer sleeves which fit about the respective axle means on a side of the resilient means opposite to the washer means.

7. A roller skate as claimed in claim 1 wherein at least one reinforcing web is located between the first and second rail means.

8. A roller skate as claimed in claim 1 including a releasable wheel stop located between the underside of a toe of the boot and the top of a front wheel of the plurality of wheels.

9. An in-line roller skate comprising:

(a) a boot adapted to receive a foot of a skater;

(b) a wheel mounting means secured to the underside of the boot, longitudinal with the boot, and having an elongated longitudinal wheel receiving Cavity therein;

(c) a plurality of wheels rotatably mounted in series within the wheel receiving cavity and longitudinal alignment with one another;

(d) a releasable wheel rotation stop means located between the underside of a toe of the boot and above a forward wheel of the plurality of wheels, said wheel rotation stop means being movable so that it can impinge against a wheel to retard rotation of the wheel.

10. A roller skate as claimed in claim 9 wherein the wheel stop means is movable between a first position wherein the stop means is free of the forward wheel and permits the forward wheel to rotate and a second position wherein the stop means abuts the forward wheel and prevents rotation of the forward wheel.

11. A roller skate as claimed in claim 10 wherein the wheel stop means has releasable lock means which enables the stop means to be locked in a first or second position.

12. A roller skate as claimed in claim 9 wherein the wheel rotation stop means is slidably mounted on the underside of the toe and is movable horizontally between a first forward position whereby the wheel rotation stop means does not impinge on a front wheel, and a second rear position whereby the wheel rotation stop means impinges on the front wheel and thereby stops rotation of the front wheel.

13. A roller skate as claimed in claim 12 wherein the wheel rotation stop means has a protrusion on each lateral side thereof, said protrusions slideably moving in respective horizontal slots on each lateral side of the wheel mounting means.

14. A roller skate as claimed in claim 12 wherein the wheel rotation stop means has a releasable lock means which enables the stop means to be releasably locked in a forward wheel-free position or releasably locked in a second rear position whereby the front wheel is prevented from rotating.

* * * * *